US011205403B2

(12) United States Patent
Ishikura

(10) Patent No.: US 11,205,403 B2
(45) Date of Patent: Dec. 21, 2021

(54) DRAWING ORDER DETERMINING METHOD, DRAWING METHOD, AND DRAWING APPARATUS

(71) Applicant: SEIKO EPSON CORPORATION, Tokyo (JP)

(72) Inventor: Keigo Ishikura, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/935,314

(22) Filed: Jul. 22, 2020

(65) Prior Publication Data

US 2021/0027749 A1 Jan. 28, 2021

(30) Foreign Application Priority Data

Jul. 23, 2019 (JP) ..... JP2019-135366

(51) Int. Cl.
*G09G 5/00* (2006.01)
*G09G 5/377* (2006.01)
*G09G 5/36* (2006.01)

(52) U.S. Cl.
CPC ..... *G09G 5/377* (2013.01); *G09G 5/363* (2013.01); *G09G 2340/0464* (2013.01); *G09G 2340/12* (2013.01); *G09G 2354/00* (2013.01)

(58) Field of Classification Search
CPC .... G06F 3/0485; G06F 16/168; G06F 16/444; G06F 2203/04804; G06F 3/048; G09G 5/397; G09G 2340/12; G09G 2340/10; G09G 3/003; G09G 5/377; G06T 2200/24
See application file for complete search history.

(56) References Cited

U.S. PATENT DOCUMENTS

2007/0009182 A1* 1/2007 Yamauchi ..... G09G 5/397 382/302
2012/0218303 A1* 8/2012 Nakada ..... G02B 27/017 345/649
2013/0332871 A1* 12/2013 Bucur ..... G06F 3/0481 715/768

FOREIGN PATENT DOCUMENTS

JP 2017-120484 A 7/2017

* cited by examiner

*Primary Examiner* — Hau H Nguyen
(74) *Attorney, Agent, or Firm* — Oliff PLC

(57) ABSTRACT

A drawing order determining method according to the present disclosure handles an image group which includes at least one transparent image and a plurality of opaque images and in which arrangement orders of the images are determined in advance and includes an identification step of identifying the positions where the transparent image and the opaque images are placed and a determination step of determining an image to be first drawn in the image group, the determination step including a first step of determining the opaque image one image downstream the transparent image when viewed from the downstream of the arrangement orders as the image to be first drawn and a second step of determining the opaque image at a most upstream arrangement order as the image to be first drawn.

9 Claims, 23 Drawing Sheets

DRAWING ORDER DETERMINING METHOD, DRAWING METHOD, AND DRAWING APPARATUS

The present application is based on, and claims priority from JP Application Serial Number 2019-135366, filed Jul. 23, 2019, the disclosure of which is hereby incorporated by reference herein in its entirety.

BACKGROUND

1. Technical Field

The present disclosure relates to a drawing order determining method, a drawing method, and a drawing apparatus.

2. Related Art

In recent years, a variety of display apparatuses employ listing a predetermined number of reduced images of a plurality of images and displaying thumbnails that allow recognition of the contents described in the read images.

As an example, there is a proposed display apparatus employing a user interface (UI) that allows a user to readily grasp the contents described in images displayed in the form of thumbnails by three-dimensionally rotating the images, that is, pages and displaying at least part of the images with part of an image overlapping with part of the adjacent image to display information on a large number of images in a single screen (see JP-A-2017-120484, for example).

The thus configured display apparatus displays some of the thumbnails in such a way that adjacent images overlap with each other, as described above.

In this process, drawing an upstream image first eliminates the necessity of drawing the region behind the upstream image and hidden by the upstream image when the downstream image is drawn, whereby the speed at which the entire thumbnails are drawn can be increased.

When at least part of the upstream image has a transparent region in the drawing of the upstream image, however, it is undesirably determined that no drawing of the portion corresponding to the transparent region is necessary even when there is a region where drawing is necessary in the downstream image. As a result, there is a conceivable problem of incorrect drawing of the downstream image corresponding to the transparent region.

SUMMARY

The present disclosure can be implemented in the form of the following application example.

A drawing order determining method according to an application example of the present disclosure handles an image group which includes at least one transparent image having a transparent portion and a plurality of opaque images each having no transparent portion and in which arrangement orders of the images are determined in advance and includes an identification step of identifying positions where the transparent image and the opaque images are placed and a determination step of determining an image to be first drawn in the image group, the determination step including a first step of determining the opaque image one image downstream the transparent image when viewed from the downstream of the arrangement orders as the image to be first drawn and a second step of determining the opaque image at a most upstream arrangement order as the image to be first drawn.

DESCRIPTION OF EXEMPLARY EMBODIMENTS

Figure 1:
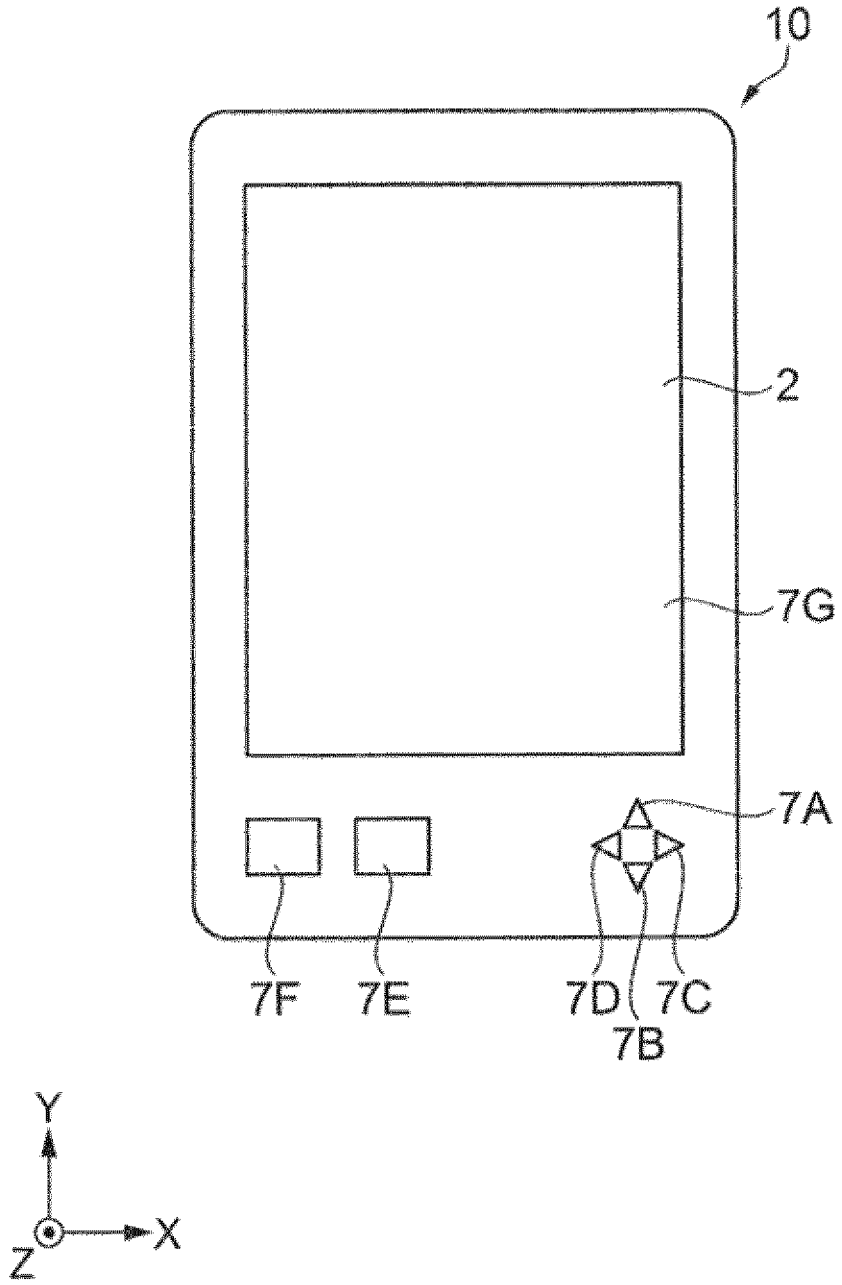
FIG. 1 is a plan view showing the exterior appearance of a viewer according to an embodiment.

A drawing order determining method, a drawing method, and a drawing apparatus according to the present disclosure will be described below in detail based on a preferable embodiment shown in the accompanying drawings.

In the embodiment shown below, before describing the drawing order determining method and the drawing method according to the present disclosure, a viewer that allows a user to view and edit an electronic manual, an electronic book, or a document created by the user, which are each an example of a document containing images, will be described as an example of the drawing apparatus according to the present disclosure, that is, a display apparatus.

In the drawings referred to in the following description, a member or a portion is drawn at longitudinal and lateral scales different from actual scales in some cases for convenience of description and illustration. Further, components other than those necessary for the description are omitted in the drawings in some cases. In the following description, FIGS. 1, 2A, 2B, 16, 17, 18, 19, 20, 21, 22 and 23 to 26 show axes X, Y, and Z as three axes perpendicular to one another, and the side facing the front end of the arrow representing any of the axes is a "+" side, and the side facing the base end of the arrow is a "−" side for ease of description. The direction along the axis X is called a "lateral direction" as a first direction, the direction along the axis Y is called a "longitudinal direction" as a second direction, and the direction along the axis Z is called a "depth direction." A side of the lateral direction that is the side corresponding to the direction −X is called left or a left side, and a side of the lateral direction that is the side corresponding to the direction +X is called right or a right side. A side of the longitudinal direction that is the side corresponding to the direction −Y is called lower or a lower side, and a side of the longitudinal direction that is the side corresponding to the direction +Y is called upper or an upper side. Out of images so arranged along the direction along the axis X that the images partially overlap with each other, an image located close to the reader (on +Z-axis side) is called an image located on the "upstream," and an image located away from the reader (on −Z-axis side) is called an image located on the "downstream" in the description. In the present embodiment, the first direction is the lateral direction, and the second direction is the longitudinal direction. Instead, the first direction may be the longitudinal direction, and the second direction may be the lateral direction. That is, the first and second directions only need to intersect each other.

Viewer

An overview of a viewer 10 will first be described with reference to FIGS. 1, 2A, and 2B.

FIG. 1 is a plan view showing the exterior appearance of the viewer according to the embodiment. FIG. 2A is a partially enlarged plan view showing a thumbnail image bundle and enlarged thumbnail images displayed on an image display section provided in the viewer shown in FIG. 1. FIG. 2B is a partially enlarged plan view in which a portion B of the thumbnail image bundle shown in FIG. 2A is partially enlarged.

In the present embodiment, the viewer 10 is a display apparatus that displays an image and includes an image display section 2, which displays the image, and buttons 7A to 7F and a touch panel 7G, which serve as an input section 7.

In this example, the viewer 10 is an apparatus for viewing an electronic book as an example of a document, or what is called an electronic book reader. The electronic book is document data containing images of a plurality of pages. The viewer 10 displays the electronic book on a certain unit basis on the image display section 2. The certain unit is, for example, a single page. Among the plurality of pages contained in the electronic book, a page to be displayed is called a selected page. The selected page is changed in accordance with the user's operation performed on any of the buttons 7A to 7F or the touch panel 7G shown in FIG. 1. That is, the user can operate the buttons 7A to 7F or the touch panel 7G to turn a page of the electronic book. The viewer 10 has the function of executing an application program in addition to the function of viewing an electronic book.

Figure 2A:
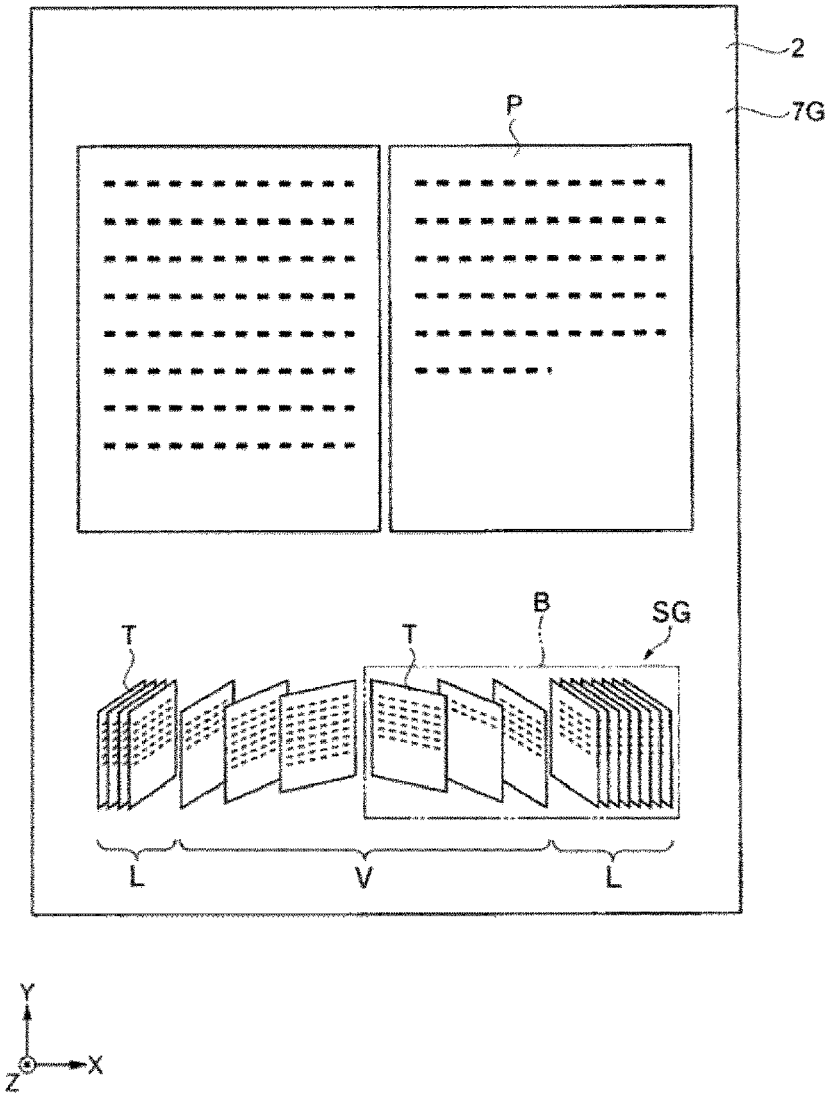
FIG. 2A is a partially enlarged plan view showing a thumbnail image bundle and enlarged thumbnail images displayed on an image display section provided in the viewer shown in FIG. 1.

The image display section 2 displays thumbnail images T as images of reduced pages of an electronic manual, an electronic book, or a document created by the user and further displays an original image P of a selected thumbnail image T, as shown in FIG. 2A. The image display section 2 displays a thumbnail image bundle SG, that is, an image group as an image bundle in which a plurality of thumbnail images T, that is, images are juxtaposed in the lateral direction.

The thumbnail image bundle SG is placed along the lower edge of the image display section 2 in a lower portion of the image display section 2 that is a portion on the lower side of the longitudinal direction, and the lower end of the thumbnail image bundle SG extends off the display region of the image display section 2 in some cases.

The thumbnail images T are images so sized as to occupy part of the image display section 2 and are reduced or enlarged original images P. Each original image Pis the image of a page of an electronic manual, an electronic book, or document data created by the user. The original image P may instead be an icon of an application program or an action screen of the application program. The application program and the actions thereof may be allocated to the plurality of thumbnail images T.

The viewer 10 includes the buttons 7A to 7F and the touch panel 7G as the input section 7 on a surface of the viewer 10 that is the surface where the image display section 2 is disposed. The input section 7 externally takes in an input. The input section 7 accepts the user's operation and processes the accepted operation as an input signal. That is, the user operates the input section 7 to input predetermined operation to the viewer 10.

System Configuration of Viewer

The system configuration of the viewer 10 described above will next be described with reference to FIGS. 3 and 4.

Figure 3:
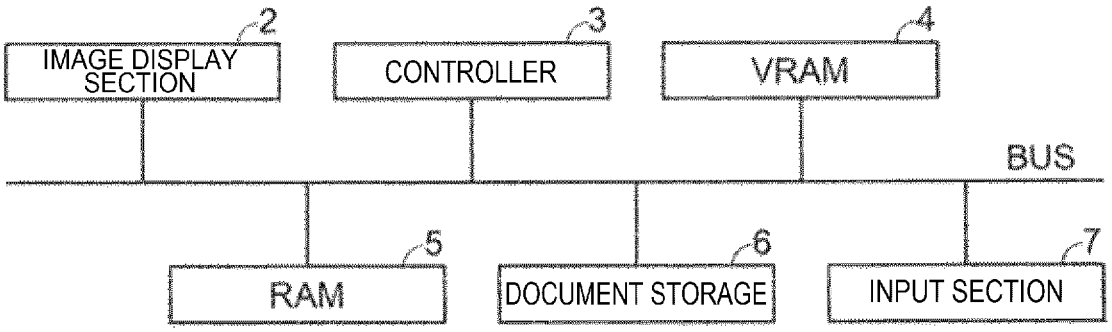
FIG. 3 is a block diagram showing the system configuration of the viewer.
Figure 4:
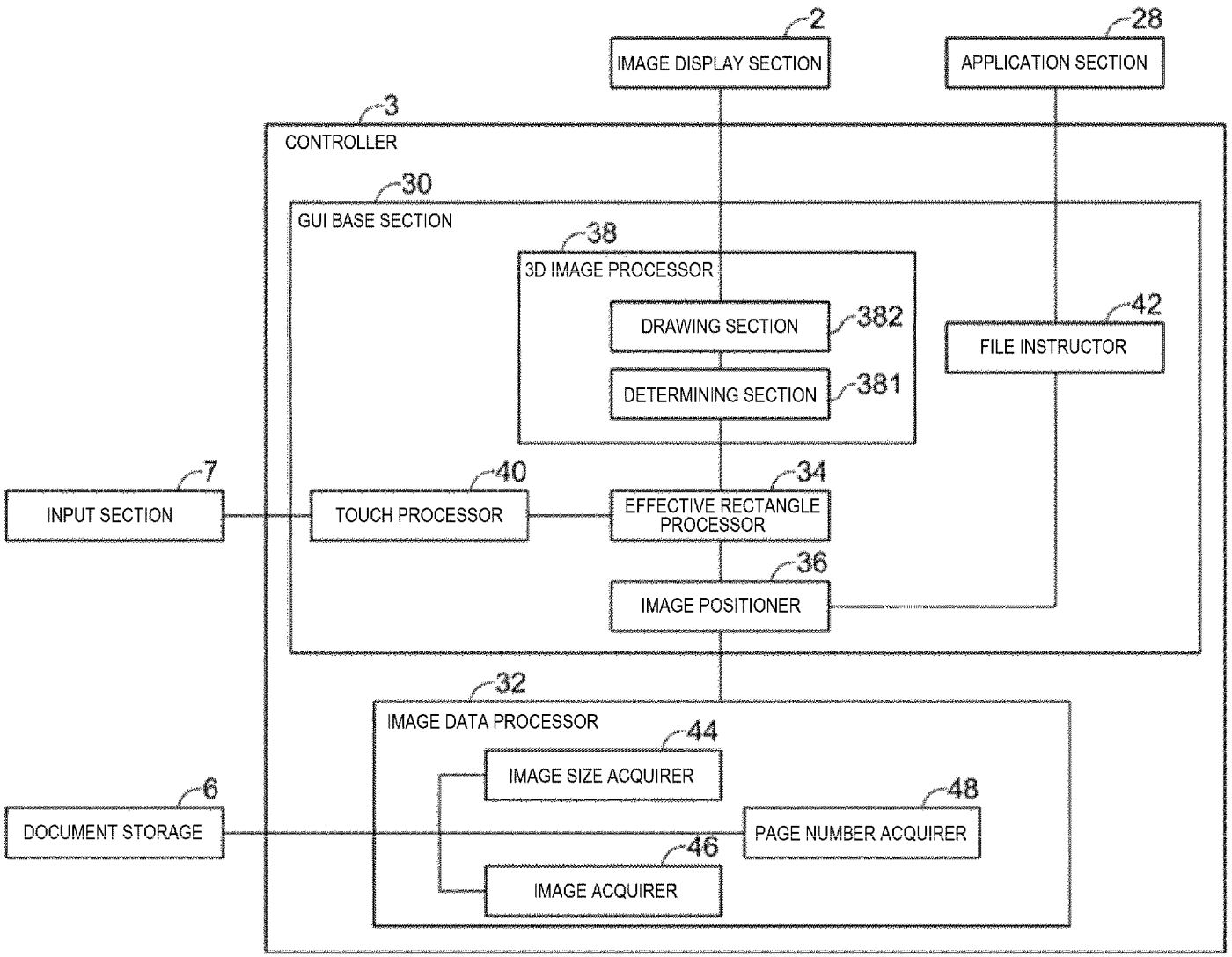
FIG. 4 is another block diagram showing the system configuration of the viewer.

FIGS. 3 and 4 are each a block diagram showing the system configuration of the viewer 10.

The viewer 10 includes the image display section 2, a controller 3, a video random access memory 4 (VRAM), a RAM 5, a document storage 6 (random access memory), and the input section 7, which are coupled to a bus BUS, as shown in FIG. 3. Communication of a signal or information between the portions coupled to the bus BUS is performed via the bus BUS.

The image display section 2 displays the thumbnail images T corresponding to the original images P and the original image P of any of the thumbnail images T. In the present embodiment, the image display section 2 displays the thumbnail image bundle SG, in which a plurality of thumbnail images T are juxtaposed in the lateral direction. The image display section 2 displays the plurality of thumbnail images T in the form of a bird's-eye view of the thumbnail image bundle SG. The image display section 2 displays a bird's-eye image that is an image of the thumbnail image bundle SG which is placed in an imaginary space having a first imaginary rotational axis Q as a first imaginary axis and a second imaginary rotational axis M as a second imaginary axis, as shown in FIG. 9E, which will be described later, and which is viewed from an arbitrary viewpoint in the imaginary space.

The image display section 2 includes a display drive circuit that is not shown but outputs a signal that causes a liquid crystal panel or any other component to display an image, and the image display section 2 displays image data stored in the VRAM 4 as an image containing the thumbnail images T and the original image P described above.

The controller 3 is an apparatus that controls each portion of the viewer 10, for example, a microcomputer including a central processing unit (CPU), a read only memory (ROM), and other components. The CPU executes a program stored in the ROM or the RAM 5 by using the RAM 5 as a work area. The ROM stores, for example, an operating system (OS) program for controlling basic actions of the viewer 10.

The controller 3 controls each portion of the viewer 10 based on the program stored in the ROM. For example, the controller 3 causes the VRAM 4 to store a variety of sets of image data, processes the input signal transmitted from the input section 7 to identify the content of operation performed on any of the buttons 7A to 7F and the touch panel 7G operated by the user, and causes the viewer 10 to operate based on the operated one of the buttons 7A to 7F and the touch panel 7G and the identified content. The controller 3 further controls image processing performed on the images to be displayed on the image display section 2. Examples of the image processing may include enlargement and display of a selected page and enhancement of displayed thumbnail images T.

The VRAM 4 is a memory that stores image data representing an image to be displayed on the image display section 2. The VRAM 4 is a memory that stores developed image data. The image data stored in the VRAM 4 is displayed on the image display section 2.

The RAM 5 is a memory that stores the relationship between the content of the image processing performed by the controller 3 and the image data.

The document storage 6 is a rewritable memory and stores document data, such as an electronic manual, an electronic book, or a document created by the user. The document storage 6 can store a plurality of different sets of document data and allows rewriting of the document data as appropriate. The document storage 6 is a nonvolatile memory that stores a variety of data and application programs in addition to the document data. The document storage 6 may, for example, be a semiconductor memory built in the viewer 10, a detachable external memory, such as an SD memory card, or a database that is communicable over a network, such as the Internet.

The input section 7 includes the buttons 7A to 7F shown in FIG. 1. When any of the buttons 7A to 7F is operated, the input section 7 transmits an input signal corresponding to the operated button to the controller 3. The input section 7 further includes the touch panel 7G.

In the thus configured viewer 10, the controller 3 includes a GUI base section 30, which serves as an image generator, and an image data processor 32, as shown in FIG. 4.

The GUI base section 30 functions as the image generator and rotates a plurality of images T arranged along the first imaginary rotational axis Q around the second imaginary rotational axis M, which intersects the first imaginary rotational axis Q, and further rotates the plurality of images T around the first imaginary rotational axis Q to create thumbnail images T. The GUI base section 30 creates a bird's-eye image that is an image of the thumbnail image bundle SG placed in the imaginary space and viewed from an arbitrary viewpoint in the imaginary space.

The GUI base section 30 includes an effective rectangle processor 34, an image positioner 36, a 3D image processor 38, a touch processor 40, and a file instructor 42.

The effective rectangle processor 34 sets a thumbnail image display region as an occupation region.

The image positioner 36 determines an angle of rotation θ by which the thumbnail images T are rotated around the second imaginary rotational axis M. The GUI base section 30 creates the thumbnail images T based on the determined angle of rotation θ.

The image positioner 36 divides the thumbnail image bundle SG formed of the plurality of images T into a static section L, where thumbnail images T are arranged with equal gaps therebetween with adjacent thumbnail images T partially overlapping each other, and a dynamic section V, where the gaps between adjacent thumbnail images T are greater than the gaps between adjacent thumbnail images T in the static section L, and the image positioner 36 calculates a standard page interval common to the static section L and the dynamic section V.

The image positioner 36 calculates the width of a spread page and the width excluding the portion occupied by the standard page intervals between the pages and the width of the spread page from the width of the entire image and divided by the pages in the dynamic section V. Further, when the dynamic section V of the thumbnail image bundle SG includes longitudinally elongated thumbnail images T mixed with laterally elongated thumbnail images TW, such as those shown in FIG. 19, the image positioner 36 employs a smaller number of pages in the dynamic section V or a sharper normal distribution applied to the arrangement of the dynamic section V than in the static section L.

The image positioner 36 performs the calculation described above to determine the arrangement orders of the plurality of thumbnail images T, which form the thumbnail image bundle SG. That is, the image positioner 36 identifies the positions where transparent images and opaque images that form the thumbnail image bundle SG are placed.

The 3D image processor 38 draws the thumbnail images T on the image display section 2 based on the arrangement orders, which have been determined by the image positioner 36, of the plurality of thumbnail images T, which form the thumbnail image bundle SG. That is, the 3D image processor 38 displays the thumbnail image bundle SG.

The 3D image processor 38 includes a determining section 381, which determines the display order, that is, drawing orders of the thumbnail images T, which form the thumbnail image bundle SG, and a drawing section 382, which displays, that is, draws the thumbnail images T on the image display section 2 in accordance with the order.

In the present disclosure, the determining section 381 includes a first determining section that determines an image to be first drawn in the thumbnail image bundle SG in the view from the downstream of the arrangement orders of the thumbnail images T, that is, determines as the image to be first drawn an opaque image as a thumbnail image T having no transparent portion that is one image behind a transparent image as a thumbnail image T having a transparent portion in the view from the downstream of the arrangement orders of the thumbnail images T. The determining section 381 further includes a second determining section that determines as the image to be first drawn an opaque image as the most upstream thumbnail image T in the arrangement orders of the thumbnail images T. The drawing section 382 then draws an image so determined by the determining section 381 as to be first drawn as an image on the image display section 2. The 3D image processor 38, which is formed of the thus configured determining section 381 and the drawing section 382, can draw the thumbnail image bundle SG on the image display section 2 at a high processing speed. The drawing performed by the 3D image processor 38 will be described later in detail.

The 3D image processor 38 is formed, for example, of a FrameBuffer or a GPU.

The touch processor 40 detects the user's operation of touching the touch panel 7G. The touch processor 40 acquires a touch signal from the touch panel 7G.

The file instructor 42 instructs the image data processor 32 to read the original image P of a page of document data based on the data supplied from the touch processor 40. The file instructor 42 is, for example, a function of Android (registered trademark), which is an operating system for mobile instruments.

The image data processor 32 is, for example, a PDF library.

The image data processor 32 includes an image size acquirer 44, an image acquirer 46, and a page number acquirer 48.

The image size acquirer 44 acquires the lateral length of the original image P of the page of the document data from the document storage 6. The image size acquirer 44 further acquires the longitudinal length of the original image P of the page of the document data from the document storage 6.

The image acquirer 46 acquires the original image P of the page of the document data, other attributes of the original image P, and information on the original image P from the document storage 6.

The information on the original image P includes information on the plurality of thumbnail images T, which form the thumbnail image bundle SG, that is, in the present disclosure, at least one transparent image having a transparent portion and a plurality of opaque images having no transparent portion, and further includes information on the arrangement orders of the thumbnail images T used when the thumbnail image bundle SG, that is, the image group is formed. That is, the image acquirer 46 acquires the original image P and the thumbnail image bundle SG, which includes the thumbnail images T including the transparent image and the opaque images and in which the arrangement orders of the thumbnail images T are determined in advance, as the information on the original image P.

The page number acquirer 48 acquires the number of pages of the document data from the document storage 6.

An application section 28 is, for example, application software, such as software for printing a photograph, a document, and other objects, software for printing new-year's cards, and software for projecting a photograph, a document, and other objects via a projector.

Action of Viewer

The action of the aforementioned viewer will next be described with reference to FIGS. 5 to 15B.

Figure 8:
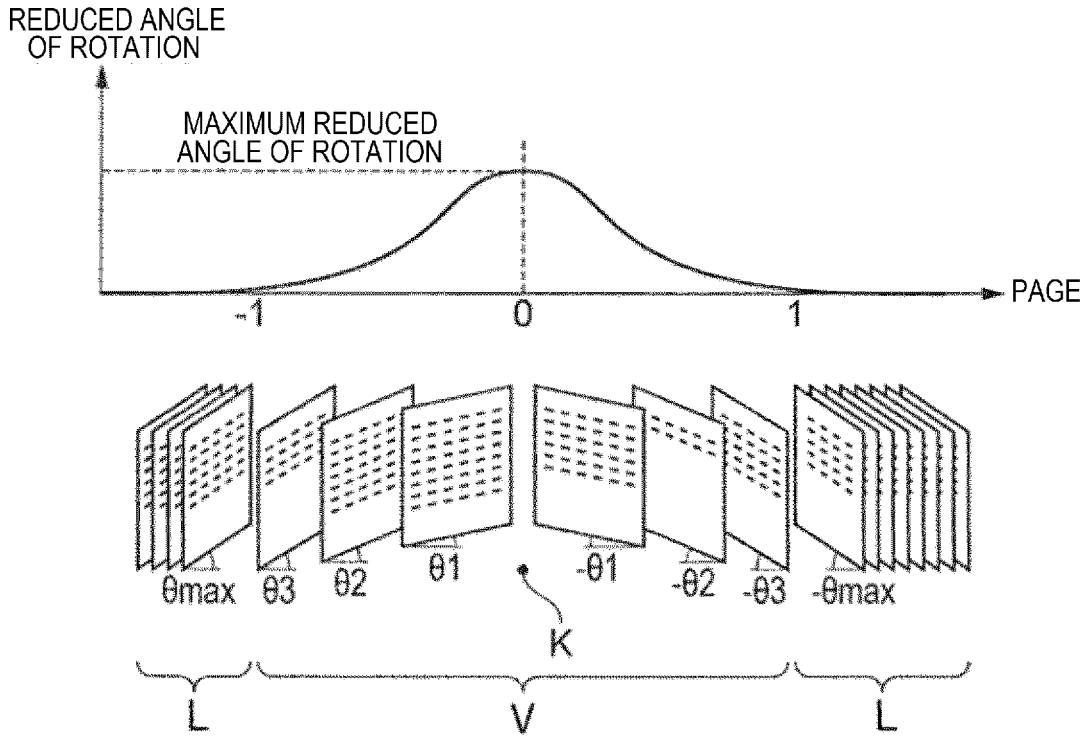
FIG. 8 describes the process of determining an angle of rotation.
Figure 10A:
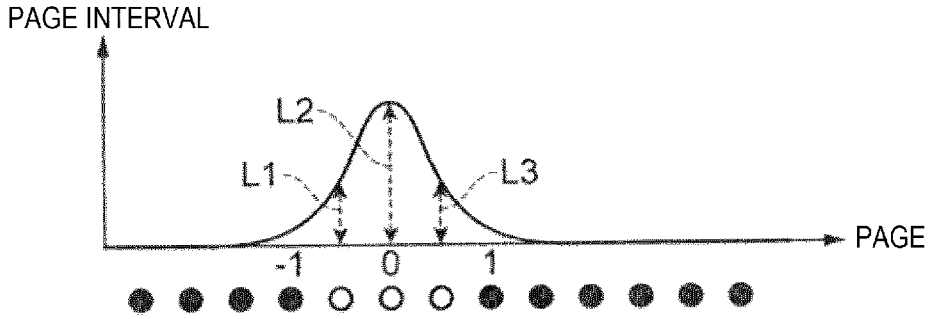
FIG. 10A describes a method for arranging the thumbnail images.
Figure 10B:
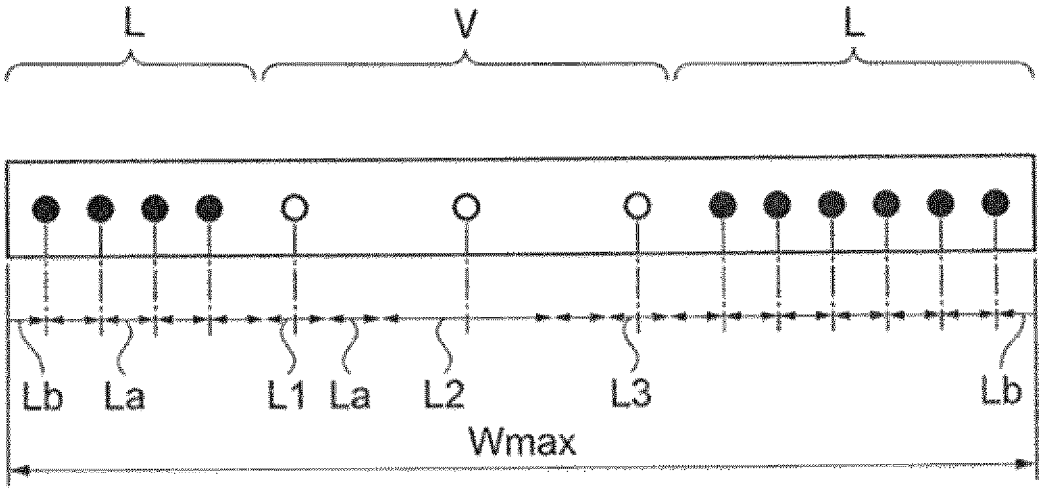
FIG. 10B describes the method for arranging the thumbnail images.
Figure 10C:
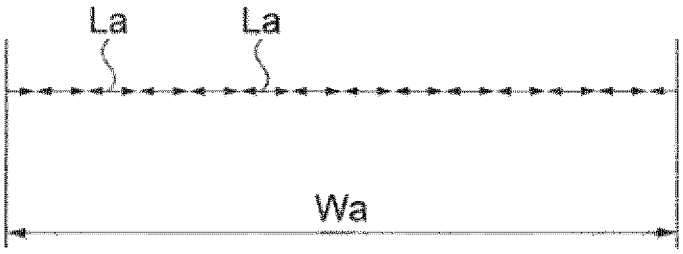
FIG. 10C describes the method for arranging the thumbnail images.
Figure 11:
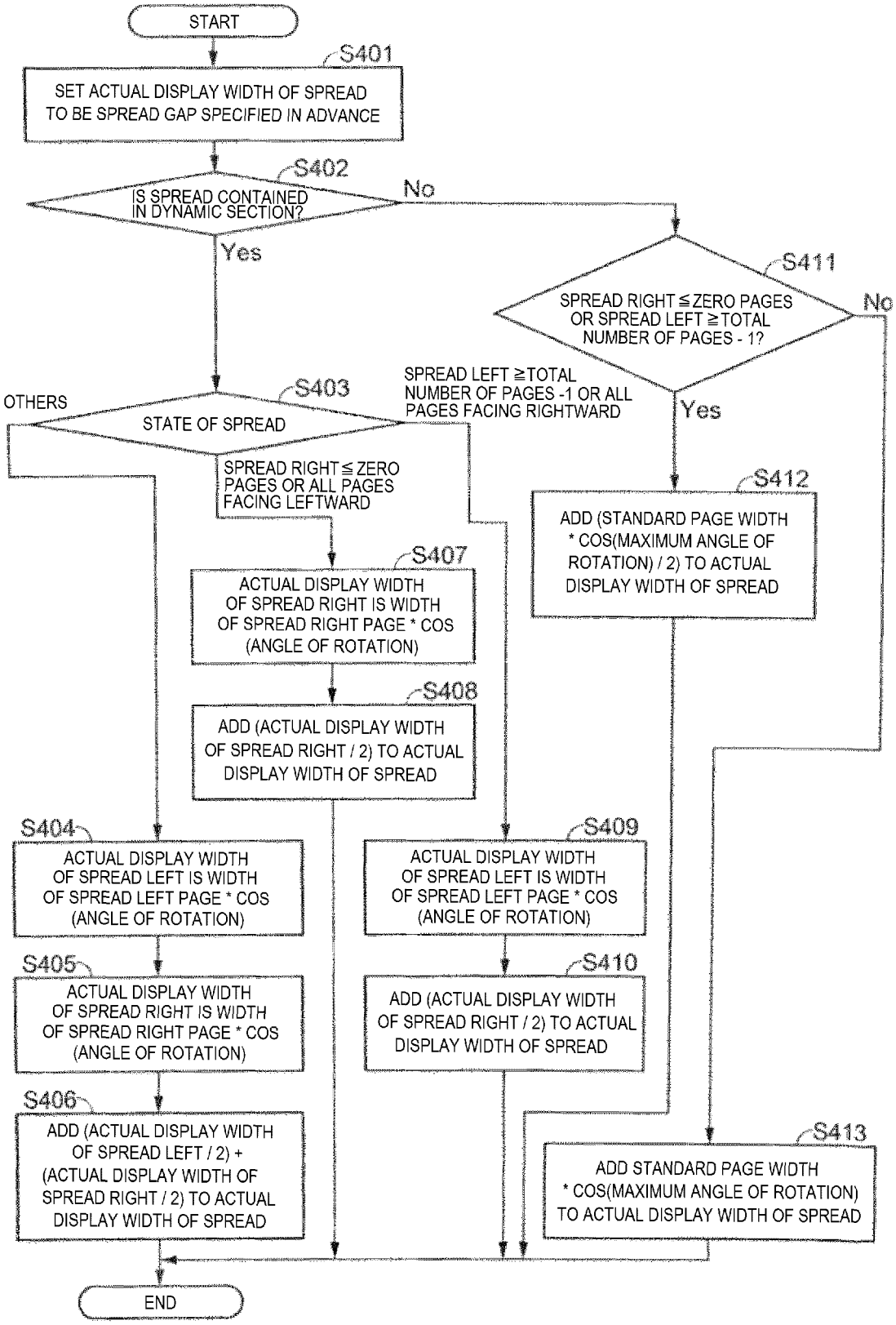
FIG. 11 is a flowchart showing an example of processes carried out by the viewer.
Figure 12:
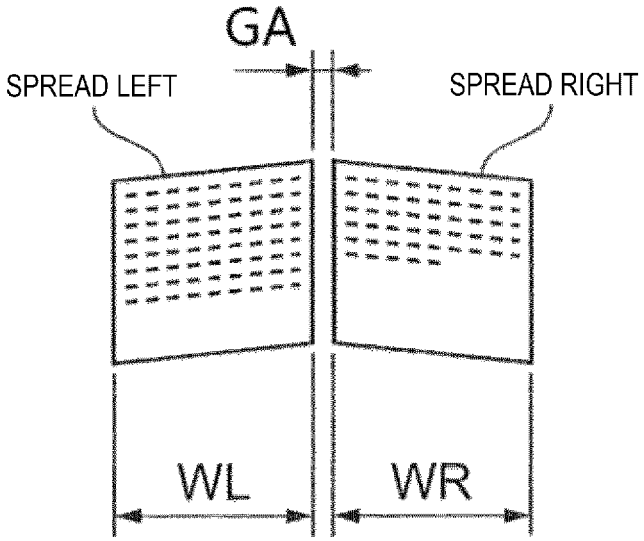
FIG. 12 describes a spread.
Figure 13:
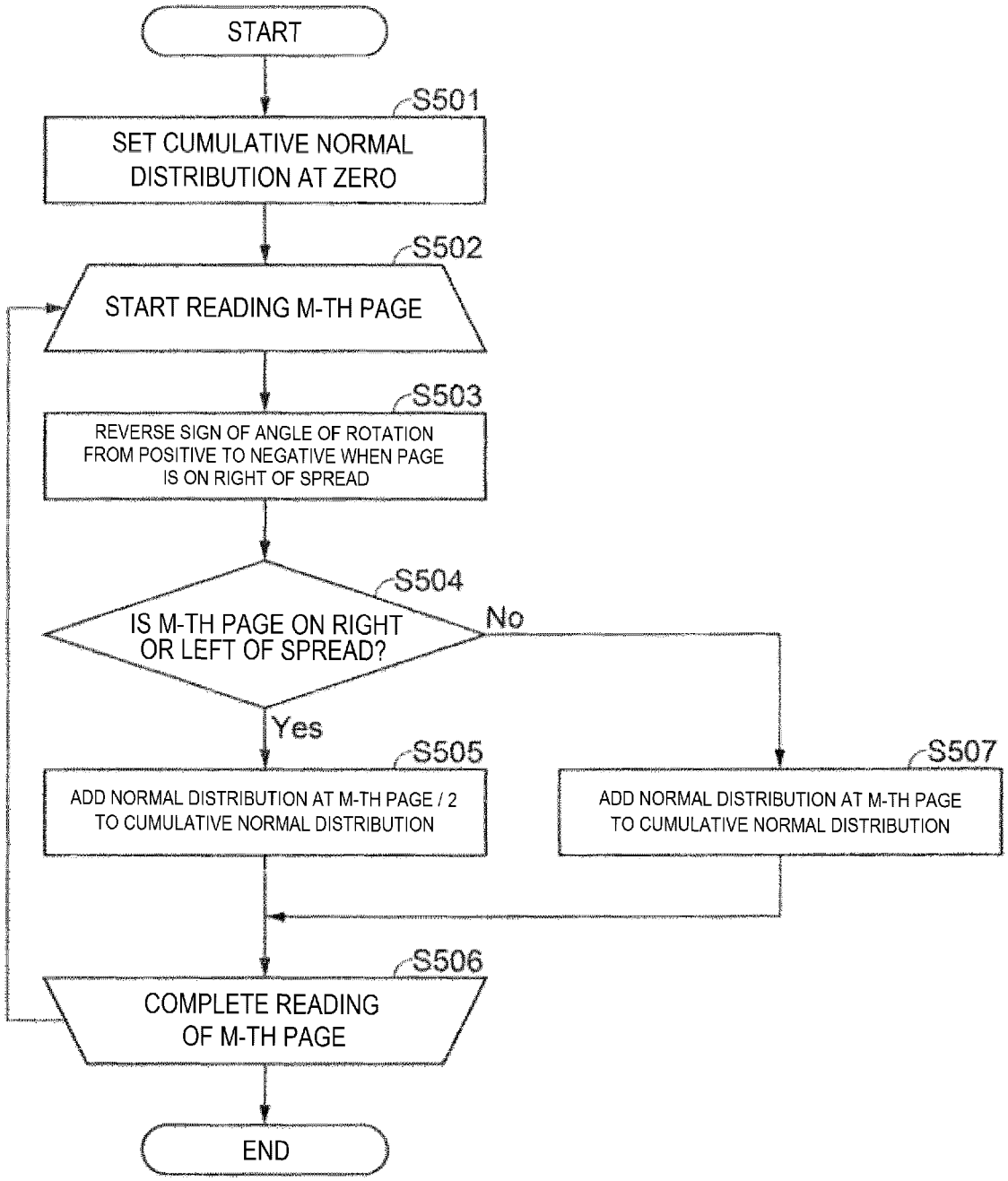
FIG. 13 is a flowchart showing an example of processes carried out by the viewer.
Figure 14:
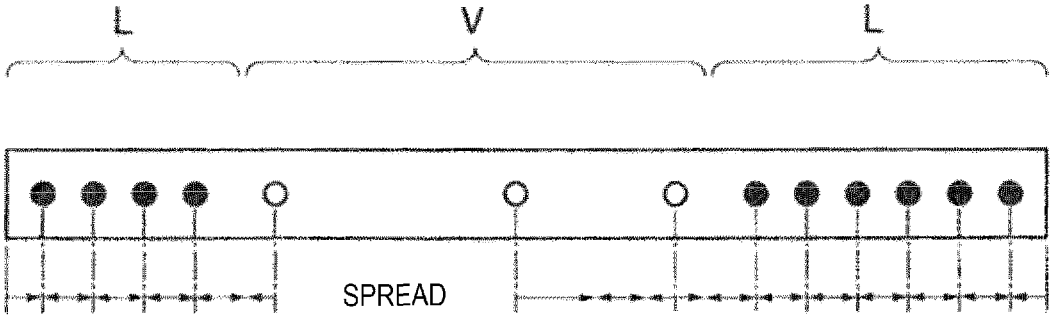
FIG. 14 describes a method for placing the spread in a dynamic section.

FIGS. 5, 6, 7, 11, 13, 15A, and 15B are flowcharts showing an example of processes carried out by the viewer 10. FIG. 8 describes the process of determining the angle of rotation θ. FIGS. 9A to 9E describe the process of generating thumbnail images. FIGS. 10A to 10C describe a method for arranging the thumbnail images. FIG. 12 describes a spread. FIG. 14 describes a method for placing the spread in the dynamic section.

The action of the controller 3 will first be described below along the flowchart shown in FIG. 5 with reference to FIGS. 2A and 2B.

Figure 2B:
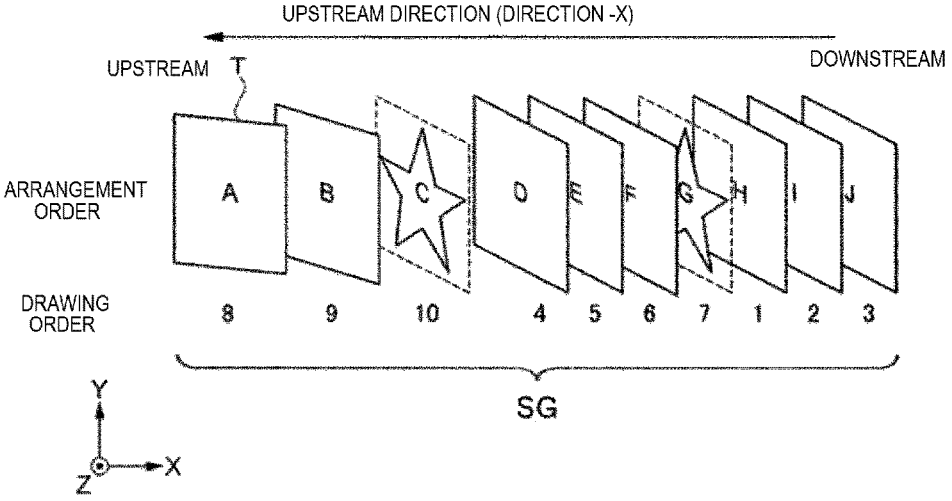
FIG. 2B is a partially enlarged plan view in which a portion B of the thumbnail image bundle shown in FIG. 2A is partially enlarged.

The controller 3 creates the thumbnail image bundle SG in which the generated thumbnail images T are arranged at predetermined orders (see FIG. 2B).

The image positioner 36 divides the thumbnail image bundle SG into the static section L and the dynamic section V and calculates the arrangement orders of the thumbnail images T in the static section L and the arrangement orders of the thumbnail images T in the dynamic section V to determine the arrangement orders of the plurality of thumbnail images T that form the thumbnail image bundle SG.

Figure 5:
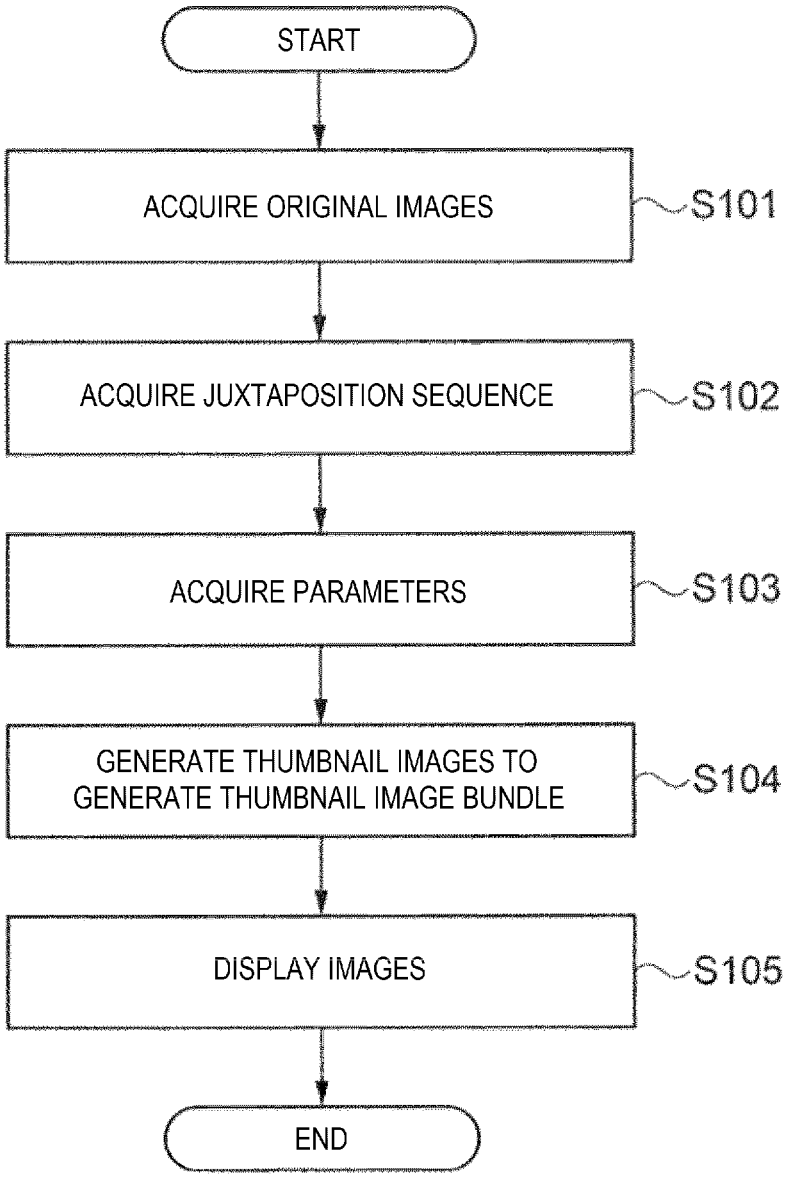
FIG. 5 is a flowchart showing an example of processes carried out by the viewer.

The procedure shown in FIG. 5 starts in response to a trigger, for example, when a predetermined event occurs, for example, when the viewer 10 is powered on or when the viewer 10 is instructed, for example, to display a menu screen.

First, in step S101, the file instructor 42 instructs the image acquirer 46 to read an original image P specified by the user who uses any of the buttons 7A to 7F or the touch panel 7G of the input section 7 from the document storage 6. The controller 3, that is, the image acquirer 46 then acquires the thumbnail image bundle SG to be processed, in this example, the original images P of the plurality of images T contained in the thumbnail image bundle SG.

In the present disclosure, the plurality of thumbnail images T acquired by the controller 3 and contained in the thumbnail image bundle SG, that is, the image group include at least one transparent image having a transparent portion and a plurality of opaque images each having no transparent portion. The transparent portion does not need to be fully transparent, and it is assumed that a transparent image has a transparent portion as long as the transparent portion is translucent enough to allow visual recognition of a thumbnail image T behind the transparent image in a see-through view.

In step S102, the controller 3, that is, the image acquirer 46 then acquires data representing the sequence in accordance with which the plurality of images T are juxtaposed.

The data contains numbers representing the juxtaposition sequence of the thumbnail images T and file names as identifiers of the thumbnail images T. The data are stored in the document storage 6. In step S101, the controller 3 reads the data from the document storage 6 and acquires the original images P having the file names contained in the data from the document storage 6. In step S102, the controller 3 then acquires from the data the pre-specified juxtaposition sequence, that is, arrangement orders of the thumbnail images T, that is, the transparent image and the opaque images in the thumbnail image bundle SG.

In step S103, the controller 3 then acquires parameters used to display the thumbnail image bundle SG. The parameters are stored in the document storage 6 along with the identifiers of the thumbnail image bundle SG. The acquired parameters include the number of images and an image width. The number of images is the parameter representing the number of thumbnail images T contained in the thumbnail image bundle SG. The image width is the parameter representing the lateral length of the thumbnail image bundle SG.

In step S104, the controller 3 then creates the thumbnail image bundle SG by using the thumbnail images T generated by the GUI base section 30. In detail, the controller 3 reduces or enlarges the original images P acquired in step S101 by the GUI base section 30 and creates the thumbnail image bundle SG by using the generated thumbnail images T.

Figure 6:
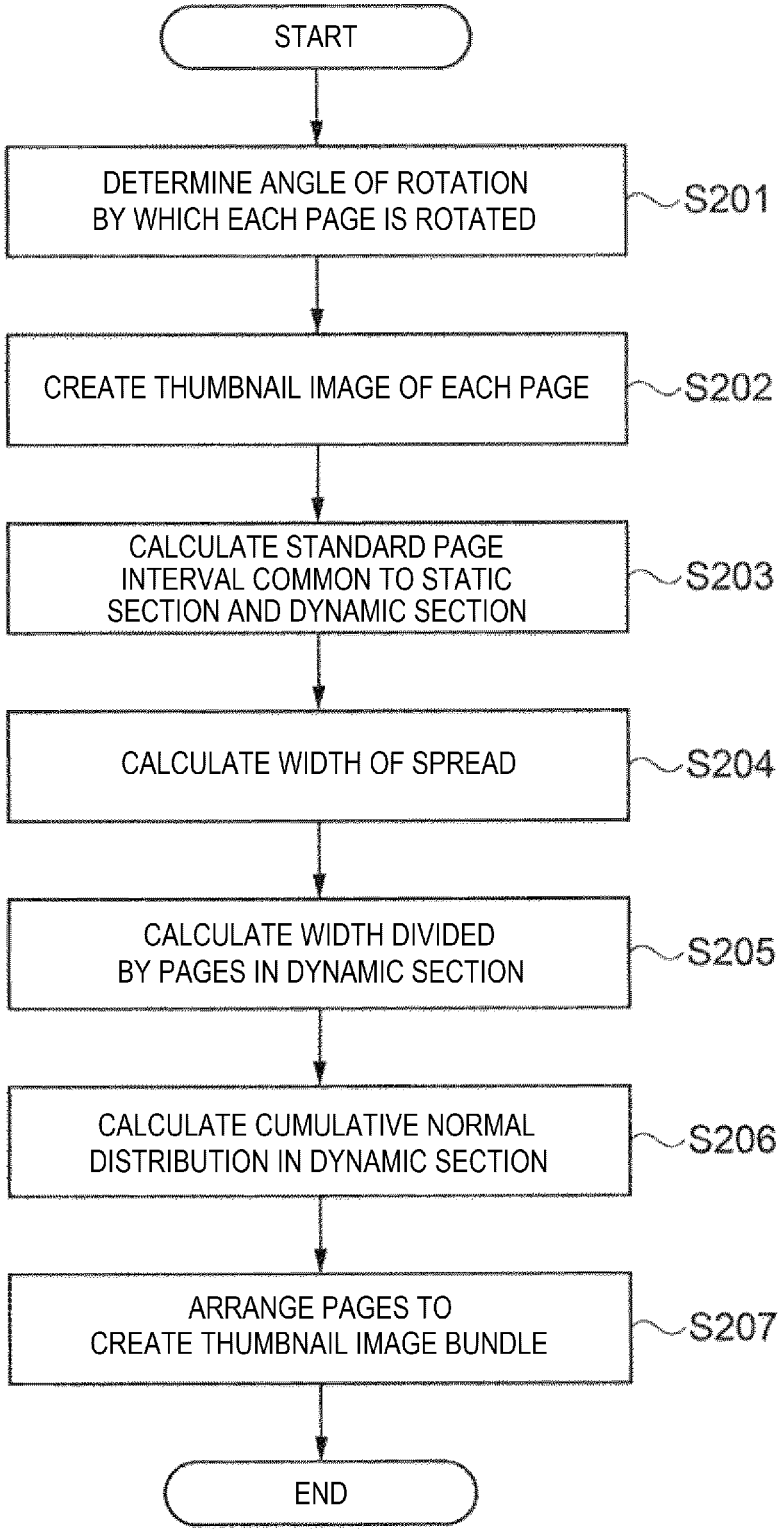
FIG. 6 is a flowchart showing an example of processes carried out by the viewer.
Figure 7:
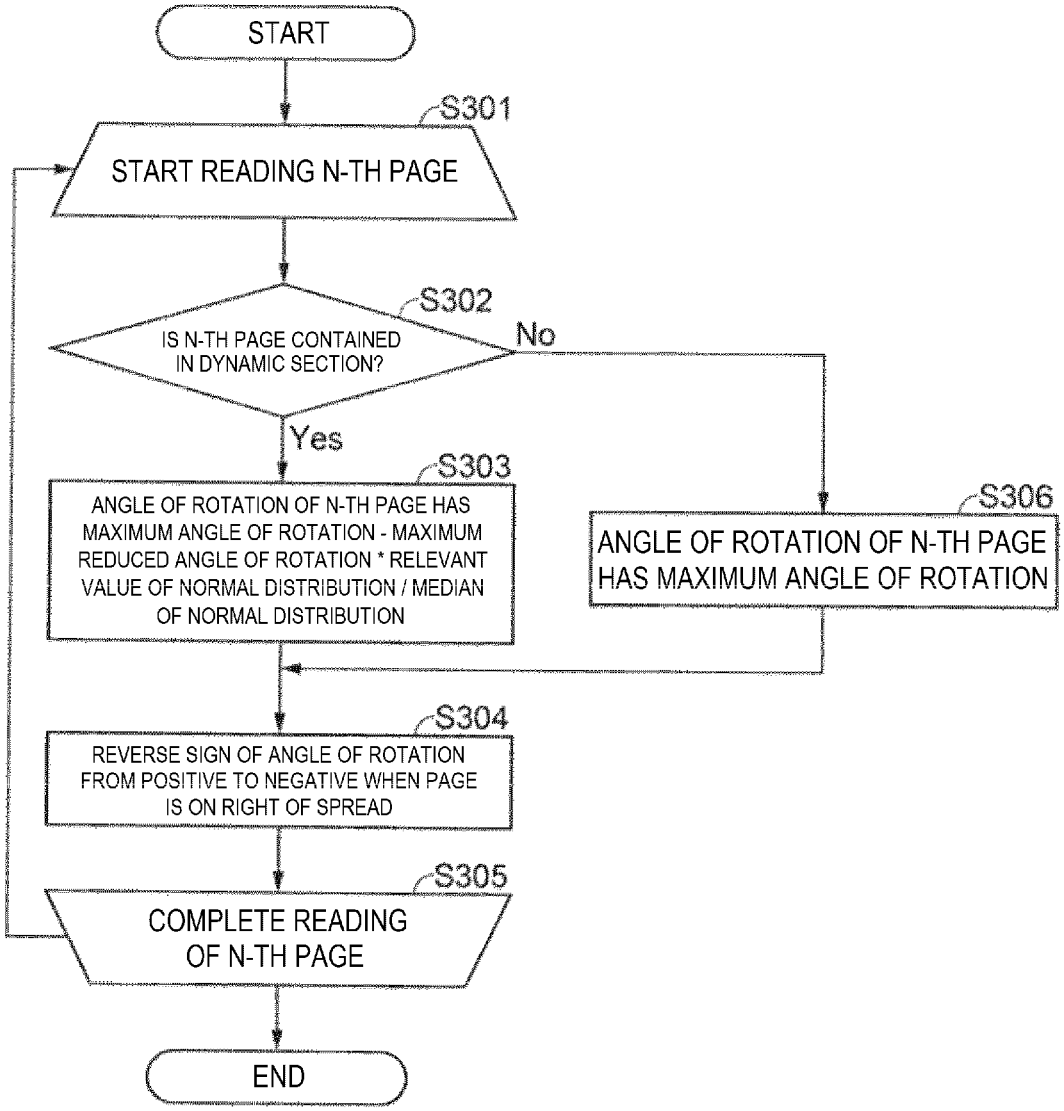
FIG. 7 is a flowchart showing an example of processes carried out by the viewer.

The drawing order determining method and the drawing method according to the present disclosure are used to create the thumbnail image bundle SG, that is, the image group, and the action of the controller 3 that creates the thumbnail images T and arranges the thumbnail images T to create the thumbnail image bundle SG will be described below along the flowchart of FIG. 6.

In step S201, the image positioner 36 first determines the angle of rotation 19, by which each page shown in FIG. 9A, which will be described later, is rotated around the second imaginary rotational axis M. The action of determining the angle of rotation 91 will be described along the flowchart of FIG. 7.

In step S301, the image positioner 36 first starts reading the N-th original image P. N is an integer greater than or equal to one.

In step S302, when the N-th page is not contained in the dynamic section V, the result of step S302 is "No," and the image positioner 36 proceeds to step S306, where the image positioner 36 sets the angle of rotation θ by which the N-th page is rotated at a maximum angle of rotation Gmax and proceeds to step S304. When the N-th page is contained in the dynamic section V, the result of step S302 is "Yes," and the image positioner 36 proceeds to step S303, where the image positioner 36 sets the angle of rotation θ by which the N-th page is rotated at a value defined by "maximum angle of rotation−maximum reduced angle of rotation*relevant value of normal distribution/median of normal distribution." The angle of rotation θ of a page placed in the dynamic section V is calculated in accordance with the normal distribution of the reduced angle of rotation, as shown in FIG. 8. The closer to a predetermined position K, which is the lateral center of the dynamic section V, the page is, the smaller the angle of rotation θ is. That is, the following expression is satisfied: angle of rotation θ1 of page closest to predetermined position K<angle of rotation θ2 of page close in second place to predetermined position K<angle of rotation θ3 of page close in third place to predetermined position K.

In step S304, the image positioner 36 then reverses the sign of the angle of rotation θ from positive to negative when the page is on the right of the spread. That is, the pages on the right of the predetermined position K are so set as to have angles of rotation −θ1, −θ2, −θ3, and −θmax.

In step S305, the image positioner 36 then returns to step S301, repeats the actions insteps S301 to S305 multiple times corresponding to the number of pages, completes the reading of the N-th page, and terminates the setting of the angle of rotation θ of each page.

Referring back to FIG. 6, in step S202, the controller 3 creates the thumbnail image T of each page. Specifically, the GUI base section 30 rotates each of the plurality of thumbnail images T arranged along the first imaginary rotational axis Q around the second imaginary rotational axis M, which intersects the first imaginary rotational axis Q, and further rotates the thumbnail image T around the first imaginary rotational axis Q to create the thumbnail image T.

Figure 9A:
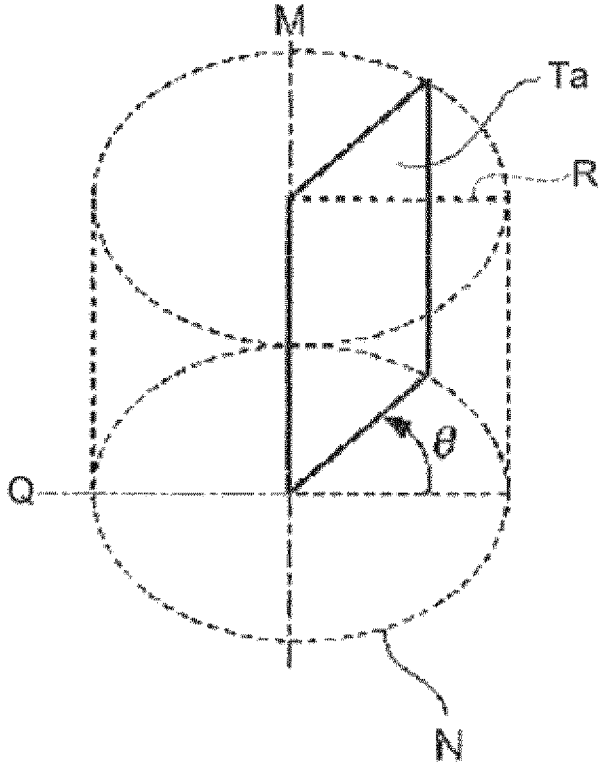
FIG. 9A describes the process of generating a thumbnail image.

That is, the GUI base section 30 places a page Ta in such a way that the page Ta stands on the first imaginary rotational axis Q set in an imaginary horizontal plane N in the imaginary space and rotates the page Ta by the angle of rotation θ from a reference position R, where the lateral direction of the page Ta is parallel to the lateral direction of the display region, around the second imaginary rotational axis M, which intersects the first imaginary rotational axis Q, as shown in FIG. 9A. Further, the GUI base section 30 creates an image by rotating the page Ta rotated around the second imaginary rotational axis Min the imaginary space by an angle of depression ϕ, which is not shown, around the first imaginary rotational axis Q. That is, the GUI base section 30 creates an image that is the page Ta rotated around the second imaginary rotational axis M and obliquely viewed down at the angle of depression ϕ, which is not shown, from a viewpoint above the upper edge of the page Ta in the imaginary space. In other words, the thumbnail images are each generated in the form of a bird's-eye image that is the page Ta obliquely viewed at the angle of depression ϕ, which is not shown, from a viewpoint above the upper edge of the page Ta in the imaginary space. Before the page is rotated, the lateral direction of the page is parallel to the lateral direction of the display region, and the angle of rotation θ is 0°. The angle of depression ϕ is an angle specified in advance. The second imaginary rotational axis M is not necessarily parallel to the edges of the page in the second direction, which is the longitudinal direction, and may instead intersect the lateral edges of the page.

Figure 9B:
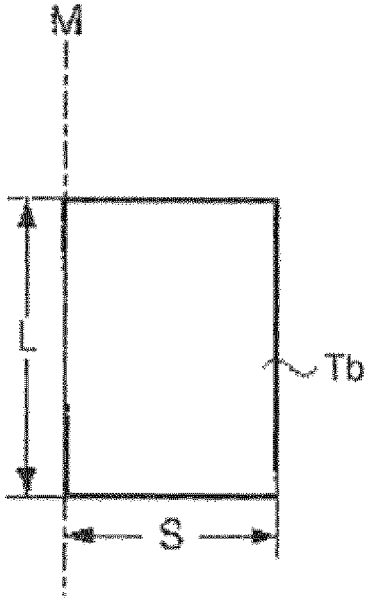
FIG. 9B describes the process of generating the thumbnail image.
Figure 9C:
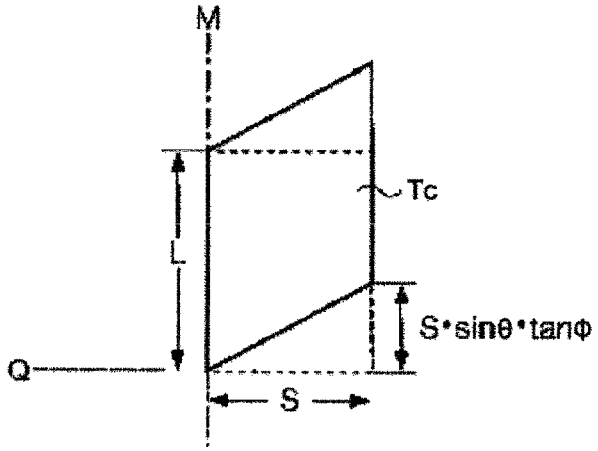
FIG. 9C describes the process of generating the thumbnail image.
Figure 9D:
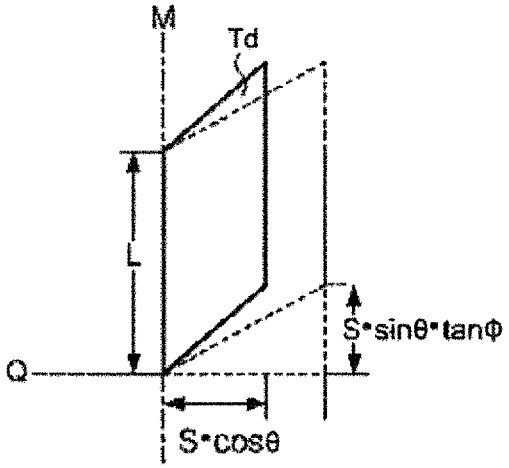
FIG. 9D describes the process of generating the thumbnail image.
Figure 9E:
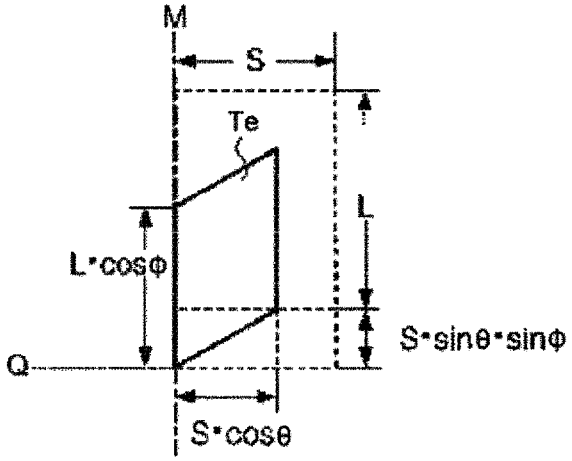
FIG. 9E describes the process of generating the thumbnail image.

Specifically, the GUI base section 30 first deforms an image Tb shown in FIG. 9B, which is an image of each page viewed from the front, in the longitudinal direction with the lateral width of the image Tb unchanged in such a way that the right edge of the image Tb in FIG. 9B is shifted relative to the left edge thereof by S·sin θ·tan ϕ to generate an image Tc, as shown in FIG. 9C. The GUI base section 30 then creates an image Td, which is the image Tc in FIG. 9C reduced in size in the lateral direction by a factor of cos θ, as shown in FIG. 9D. As a result, the lateral width of the image Td is S·cos θ. Thereafter, the GUI base section 30 finally creates an image Te, which is the image Td in FIG. 9D reduced in size in the longitudinal direction by a factor of cost, as shown in FIG. 9E. As a result, the longitudinal dimension of the image Te is L·cos ϕ. The thus generated thumbnail image T is an image of the page rotated by the angle of rotation θ around the second imaginary rotational axis M and further rotated around the first imaginary axis rotational Q. In other words, the generated thumbnail image T is an image of the page rotated around the second imaginary rotational axis M by the angle of rotation θ and viewed down at the angle of depression ϕ from a viewpoint above the upper edge of the page.

Referring back to FIG. 6 again, in step S203, the image positioner 36 calculates a standard page interval La common to the dynamic section V and the static section L.

The standard page interval La is calculated by "overall occupation width*standard page interval occupation width ratio/(number of pages−1).” When the page interval follows the normal distribution shown in FIG. 10A, the page interval in the static section L is the standard page interval La, and the page interval in the dynamic section V varies as follows: the standard page interval La; a page interval L1; the standard page interval La; a page interval L2; the standard page interval La; a page interval L3; and the standard page interval La, as shown in FIG. 10B. The overall occupation width is a length Wmax formed of the sum of the page intervals in the static section L and the sum of the page intervals in the dynamic section V to which two page intervals Lb at opposite ends are added, the page intervals Lb each corresponding to half of “standard page width*cos (maximum angle of rotation θ max).” The standard page interval occupation width ratio is the ratio of a length Wa of the standard page interval occupation width excluding the page intervals L1, L2, and L3 in the dynamic section V to the length Wmax of the overall occupation width, as shown in FIG. 10C.

In step S204, the image positioner 36 then calculates the width of the spread. The spread is two thumbnail images T that sandwich the predetermined position K in the dynamic section V shown in FIG. 8.

The action of the image positioner 36 that calculates the width of the spread will be described below along the flowchart of FIG. 11.

In step S401, the image positioner 36 first sets the actual display width of the spread to be a spread gap GA specified in advance. The spread gap GA is the gap between the spread right page and the spread left page, as shown in FIG. 12.

Thereafter, in step S402, when the spread is contained in the dynamic section V, the result of step S402 is “Yes,” and the image positioner 36 proceeds to step S403. In step S403, when the state of the spread is “others,” which is not “spread left≥total number of pages−1 or all pages facing rightward” or “spread right≤zero pages or all pages facing leftward”, the image positioner 36 proceeds to step S404, where the image positioner 36 sets an actual display width WL of the spread left to be “width of spread left page*cos (angle of rotation θ).” The phrase “all pages facing rightward” means a case where all pages are each “spread left” in FIG. 12, and the phrase “all pages facing leftward” means a case where all pages are each “spread right” in FIG. 12.

In step S405, the image positioner 36 then sets an actual display width WR of the spread right to be “width of spread right page*cos (angle of rotation θ).”

In step S406, the image positioner 36 then adds “(actual display width WL of spread left/2)+(actual display width WR of spread right/2)” to the actual display width of the spread and terminates the calculation of the actual display width of the spread.

Returning to step S403, when the state of the spread is “spread right≤zero pages or all pages facing leftward,” the image positioner 36 proceeds to step S407, where the image positioner 36 sets the actual display width WR of the spread right to be “width of spread right page*cos (angle of rotation θ).”

In step S408, the image positioner 36 then adds “(actual display width WR of spread right/2)” to the actual display width of the spread and terminates the calculation of the actual display width of the spread.

Returning to step S403 again, when the state of the spread is “spread left≥total number of pages−1 or all pages facing rightward,” the image positioner 36 proceeds to step S409, where the image positioner 36 sets the actual display width WL of the spread left to be “width of spread left page*cos (angle of rotation θ).”

In step S410, the image positioner 36 then adds “(actual display width WL of spread left/2)” to the actual display width of the spread and terminates the calculation of the actual display width of the spread.

Thereafter, returning to step S402, when the spread is not contained in the dynamic section V, the result of step S402 is “No,” and the image positioner 36 proceeds to step S411. In step S411, when the state of the spread is “spread right≤zero pages or spread left total number of pages−1,” the result of step S411 is “Yes,” and the image positioner 36 proceeds to step S412.

In step S412, the image positioner 36 adds “standard page width*cos(maximum angle of rotation θmax)/2” to the actual display width of the spread and terminates the calculation of the actual display width of the spread.

Thereafter, returning to step S411, when the state of the spread is not “spread right≤zero pages or spread left≥total number of pages−1,” the result of step S411 is “No,” and the image positioner 36 proceeds to step S413. In step S413, the image positioner 36 adds “standard page width*cos(maximum angle of rotation θmax)” to the actual display width of the spread and terminates the calculation of the actual display width of the spread.

Referring back to FIG. 6 again, in step S205, the image positioner 36 calculates the width divided by the pages in the dynamic section V.

The width divided by the pages in the dynamic section V is calculated by “overall occupation width*(1−standard page interval occupation width ratio)−actual display width of spread.” The overall occupation width is the length Wmax formed of the sum of the page intervals in the static section L and the sum of the page intervals in the dynamic section V to which one page intervals in the static section L is added, as described above. The standard page interval occupation width ratio is the ratio of the length Wa of the standard page interval occupation width to the length Wmax of the overall occupation width.

In step S206, the image positioner 36 then calculates a cumulative normal distribution in the dynamic section V.

The action of the image positioner 36 that calculates the cumulative normal distribution in the dynamic section will be described below along the flowchart of FIG. 13.

In step S501, the image positioner 36 first sets the cumulative normal distribution at “0”.

In step S502, the image positioner 36 then starts reading the M-th page in the dynamic section V. M is an integer greater than or equal to one.

In step S503, the image positioner 36 then reverses the sign of the angle of rotation θ from positive to negative when the page is on the right of the spread.

Thereafter, in step S504, when the M-th page is on the right or left of the spread, the result of step S504 is “Yes,” and the image positioner 36 proceeds to step S505. In step S505, the image positioner 36 adds “normal distribution at M-th page/2” to the cumulative normal distribution.

In step S506, the image positioner 36 then completes the reading of the M-th page and terminates the calculation of the cumulative normal distribution.

Returning to step S504, when the M-th page is not on the right or left of the spread, the result of step S504 is “No,” and the image positioner 36 proceeds to step S507. In step S507, the image positioner 36 adds “normal distribution at M-th page” to the cumulative normal distribution.

In step S506, the image positioner 36 then returns to step S502, repeats the actions insteps S502 to S506 multiple times corresponding to the number of pages, completes the reading of the M-th page, and terminates the calculation of the cumulative normal distribution.

The aforementioned calculation of the cumulative normal distribution allows calculation of the arrangement in which a spread is present in the dynamic section V, as shown in FIG. 14.

Referring back to FIG. 6 again, in step S207, the image positioner 36 arranges the thumbnail images T of the pages to create the thumbnail image bundle SG.

Figure 15A:
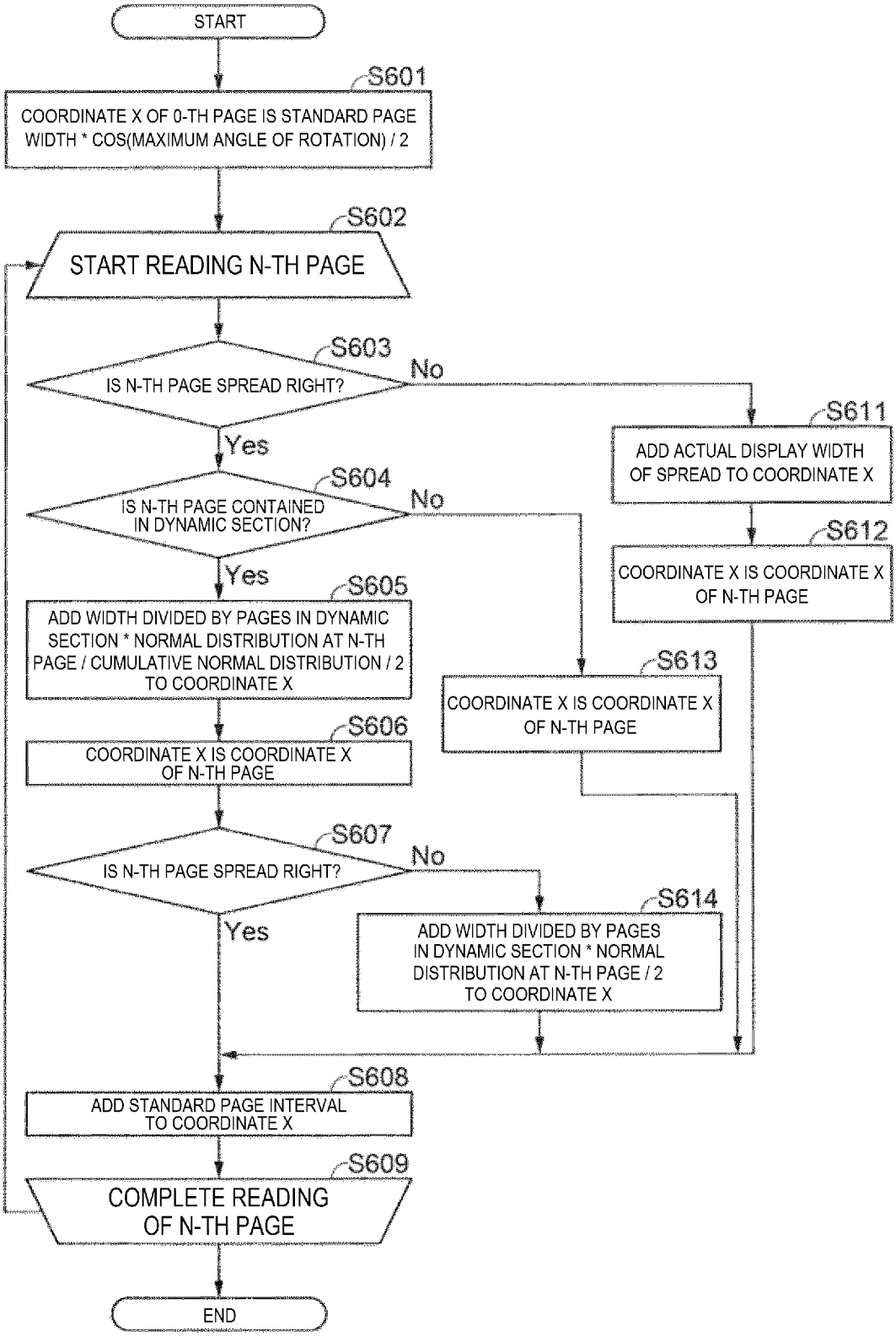
FIG. 15A is a flowchart showing an example of processes carried out by the viewer.

The action of the image positioner 36 that arranges the pages will be described below along the flowchart of FIG. 15A.

In step S601, the image positioner 36 first sets the coordinate X of the 0-th page at "standard page width La*cos(maximum angle of rotation θmax)/2." Assuming that the left end of the first page out of the opposite ends thereof facing each other in the lateral direction corresponds to the coordinate X of zero, the coordinate X is the length from the left end in the direction axis-X, which is the lateral direction.

In step S602, the image positioner 36 then starts reading the N-th original image P. N is an integer greater than or equal to one.

Thereafter, in step S603, when the N-th page is the spread right, the result of step S603 is "Yes," and the image positioner 36 proceeds to step S604. In step S604, when the N-th page is contained in the dynamic section V, the result of step S604 is "Yes," and the image positioner 36 proceeds to step S605.

In step S605, the image positioner 36 then adds "width divided by pages in dynamic section*normal distribution at N-th page/cumulative normal distribution/2" to the coordinate X.

In step S606, the image positioner 36 then sets the coordinate X at the coordinate X of the N-th page.

Thereafter, in step S607, when the N-th page is the spread right, the result of step S607 is "Yes," and the image positioner 36 proceeds to step S608. In step S607, when the N-th page is not the spread right, the result of step S607 is "No," and the image positioner 36 proceeds to step S614. In step S614, the image positioner 36 adds "width divided by pages in dynamic section*normal distribution at N-th page/2" to the coordinate X and proceeds to step S608.

Thereafter, returning to step S604, when the N-th page is not contained in the dynamic section V, the result of step S604 is "No," and the image positioner 36 proceeds to step S613. In step S613, the image positioner 36 sets the coordinate X at the coordinate X of the N-th page and proceeds to step S608.

Thereafter, returning to step S603, when the N-th page is not the spread right, the result of step S603 is "No," and the image positioner 36 proceeds to step S611. In step S611, the image positioner 36 adds the actual display width of the spread to the coordinate X.

In step S612, the image positioner 36 then sets the coordinate X at the coordinate X of the N-th page and proceeds to step S608.

In step S608, the image positioner 36 then adds the standard page interval La to the coordinate X. In step S609, the image positioner 36 returns to step S602, repeats the actions in steps S602 to S609 multiple times corresponding to the number of pages, completes the reading of the N-th page, and terminates the calculation of the coordinate X of each page.

Thereafter, based on the coordinates X of the pages calculated by the image positioner 36, the thumbnail images T produced by the GUI base section 30 and corresponding to the pages are arranged along the first imaginary rotational axis Q. The generation of the thumbnail image bundle SG is thus terminated. In this process, the drawing order determining method according to the present disclosure is applied to the determination of the arrangement orders in accordance with which the thumbnail images T are arranged along the first imaginary rotational axis Q.

Figure 15B:
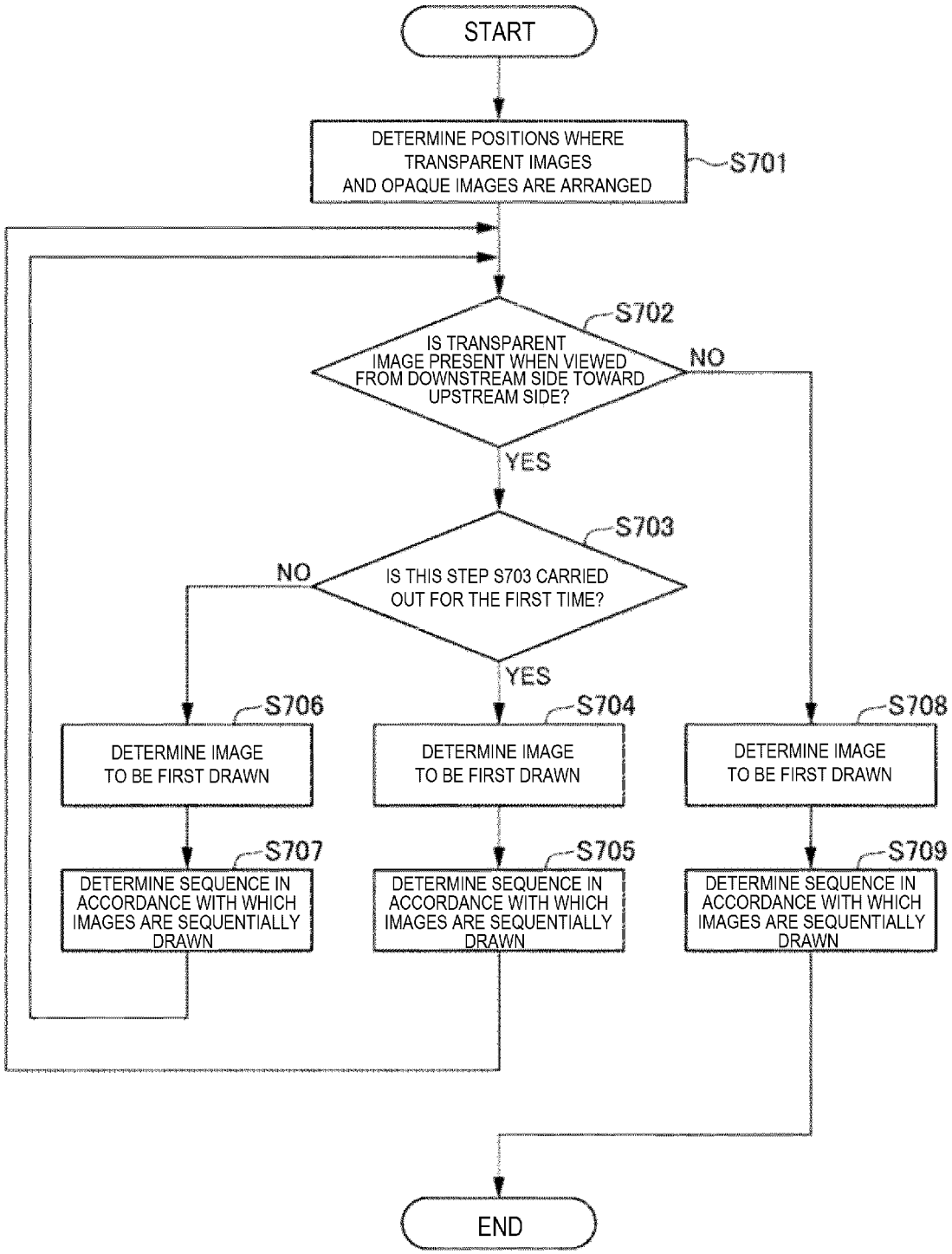
FIG. 15B is a flowchart showing an example of processes carried out by the viewer.

The action performed by the image positioner 36 and the 3D image processor 38 that determine the arrangement orders in accordance with which the pages, that is, the thumbnail images T are arranged will be described below along the flowchart of FIG. 15B.

The following description will be made with reference to a case where the thumbnail images T located on the right of the thumbnail image T that is the spread right out of the thumbnail images T provided in the thumbnail image bundle SG, as shown in FIG. 2B, are used to determine the drawing orders in accordance with which the thumbnail images T are drawn and the thumbnail images T are then drawn in accordance with the drawing orders. In the description, no description will be made of the thumbnail images T located on the left of the thumbnail image T that is the spread left because the thumbnail images T located on the right may be reversed as in formation of a mirror image and the determination and drawing described above may be performed by using the direction +X as the upstream direction.

In step S701, the image positioner 36 first identifies the positions where transparent images each having a transparent portion and opaque images each having no transparent portion are located in each of the pages, that is, each of the thumbnail images T in the thumbnail image bundle SG that are arranged along the first imaginary rotational axis Q and have determined coordinates X (identification step).

Specifically, in the present embodiment, the thumbnail images T placed in the positions indicated by the arrangement orders C and G are the transparent images, and the thumbnail images T located in the positions indicated by the other arrangement orders are the opaque images, as shown in FIG. 2B. The image positioner 36 identifies the positions of the transparent images and the opaque images placed in the positions indicated by the arrangement orders described above.

Out of the thumbnail images T, the transparent images each preferably have a flag showing that the transparent image has a transparent portion. The transparent images can thus be relatively readily identified out of the plurality of thumbnail images T.

Thereafter, in step S702, when the thumbnail image bundle SG is viewed from the downstream of the arrangement orders, that is, from the downstream that is the +X-direction side toward the upstream that is the −X-direction side in FIG. 2B, and when a transparent image is present, the result of step S702 is "Yes," and the 3D image processor 38 proceeds to step S703. In step S703, when the step S703 is carried out for the first time, the result of step S703 is "Yes," and the 3D image processor 38 proceeds to step S704.

In step S704, the 3D image processor 38 then determines, as the image to be first drawn, the opaque image one image behind the transparent image when viewed from the downstream of the arrangement orders.

Specifically, in the present embodiment, the 3D image processor 38 determines, as the image to be first drawn, the opaque image at the arrangement order H, which is placed one image downstream the transparent image placed in the position indicated by the arrangement order G, that is, one image proceeding in the direction +X when viewed from the downstream of the arrangement orders, that is, from the positive side of the direction X toward the negative side of the direction X, as shown in FIG. 2B.

Step S704 forms a first step of determining, as the image to be first drawn, the opaque image one image downstream the transparent image when viewed from the downstream of the arrangement orders.

In step S705, the 3D image processor 38 then determines the orders of the opaque images sequentially arranged downstream from the image to be first drawn, that is, in the direction +X as the sequence in accordance with which the images are sequentially drawn, that is, the drawing orders.

Specifically, in the present embodiment, the opaque images at the arrangement orders I and J, which are sequentially arranged downstream, that is, in the direction +X from the opaque image at the arrangement order H as the image to be first drawn, are determined as the sequence in accordance with which the thumbnail images T are sequentially drawn, as shown in FIG. 2B. That is, it is determined that the opaque images at the arrangement orders H, I, and J are sequentially drawn in this sequence.

It is, however, noted that in another configuration example different from the present embodiment, in which the drawing sequence is determined as described above, the 3D image processor 38 can instead determine, as the sequence in accordance with which the images are sequentially drawn, the orders of the opaque images sequentially arranged downstream from the image to be first drawn and the order of the transparent image used to determine the image drawing sequence in step S705.

Specifically, in the other configuration example, the drawing orders of the opaque images at the arrangement orders I and J, which are sequentially arranged downstream, that is, in the direction +X from the opaque image at the arrangement order H as the image to be first drawn, and the transparent image at the arrangement order G can be determined as the sequence in accordance with which the thumbnail images T are sequentially drawn, that is, it can be determined that the opaque images at the arrangement orders H, I, and J and the transparent image at the arrangement order G are sequentially drawn in this sequence.

Thereafter, returning to step S702, when the thumbnail image bundle SG is viewed from the downstream of the arrangement orders, that is, from downstream toward the upstream, and when another transparent image different from the transparent images having a determined drawing order is present, the result of step S702 is "Yes," and the 3D image processor 38 proceeds to step S703. When the step S703 is carried out second time or later, the result of step S703 is "No," and the 3D image processor 38 proceeds to step S706.

In step S706, the 3D image processor 38 then determines, as the image to be first drawn, the opaque image one image downstream a transparent image when viewed from the downstream of the arrangement orders excluding the thumbnail images T each having a drawing order determined in the steps described above.

Specifically, in the present embodiment, the 3D image processor 38 determines, as the image to be first drawn, the opaque image at the arrangement order D placed one image downstream the transparent image placed at the position indicated by the arrangement order C, as shown in FIG. 2B.

Step S706 also forms the first step of determining, as the image to be first drawn, the opaque image one image downstream the transparent image when viewed from the downstream of the arrangement orders.

In step S707, the 3D image processor 38 determines, as the sequence in accordance with which the images are sequentially drawn, the orders of the opaque images sequentially arranged downstream from the image to be first drawn and the transparent image used to determine the image drawing sequence in step S704, which is the preceding step.

Specifically, in the present embodiment, the opaque images at the arrangement orders E and F, which are sequentially arranged downstream from the opaque image at the arrangement order D as the image to be first drawn, and the transparent image at the arrangement order G are determined as the sequence in accordance with which the thumbnail images T are sequentially drawn, as shown in FIG. 2B. That is, it can be determined that the opaque images at the arrangement orders D, E, and F and the transparent image at the arrangement order G are sequentially drawn in this sequence.

It is, however, noted that in another configuration example different from the present embodiment, in which the drawing sequence is determined as described above, the 3D image processor 38 can instead determine, as the sequence in accordance with which the images are sequentially drawn, the orders of the opaque images sequentially arranged downstream from the image to be first drawn and the order of the transparent image used to determine the image drawing sequence in step S707.

Specifically, in the other configuration example, the drawing orders of the opaque images at the arrangement orders E and F, which are sequentially arranged downstream, that is, in the direction +X from the opaque image at the arrangement order D as the image to be first drawn, and the transparent image at the arrangement order C can be determined as the sequence in accordance with which the thumbnail images T are sequentially drawn, that is, it can be determined that the opaque images at the arrangement orders D, E, and F and the transparent image at the arrangement order C are sequentially drawn in this sequence.

When the number of transparent images is n (n is an integer greater than or equal to two), the procedure formed of steps S702, S703, S706, and S707 is repeatedly carried out until n is reached.

That is, when the thumbnail image bundle SG has n (n is an integer greater than or equal to two) transparent images, the first step including step S706 is repeated n times, and then a second step including step S708, which will be described later, is carried out.

Thereafter, returning to S702, when the thumbnail image bundle SG excluding the thumbnail images T having the drawing sequence determined in the steps described above is viewed from the downstream of the arrangement orders and no transparent image is present, the result of step S702 is "No," and the 3D image processor 38 proceeds to step S708. In step S708, the 3D image processor 38 determines the opaque image at the most upstream arrangement order, that is, in the most upstream position in the direction −X as the image to be first drawn.

Specifically, in the present embodiment, the 3D image processor 38 determines the opaque image located at the arrangement order A, which is the most upstream arrangement order as the image to be first drawn, as shown in FIG. 2B.

Step S708 forms the second step of determining the opaque image at the most upstream arrangement order as the image to be first drawn, and the first step described above and the second step in the present description form a determination step of determining the image to be first drawn in the thumbnail image bundle SG, that is, the image group.

In step S709, the 3D image processor 38 then determines, as the sequence in accordance with which the images are sequentially drawn, the orders of the opaque images sequentially arranged downstream, that is, indirection +X from the first drawn image and the transparent image used to determine the images drawing sequence in step S704 or S706, which is the preceding step, and determines the orders in accordance with which the thumbnail images T are drawn.

Specifically, in the present embodiment, the opaque image at the arrangement order B and the transparent image at the arrangement order C, which are sequentially arranged downstream, that is, in the direction +X from the opaque image at the arrangement order A as the image to be first drawn are determined as the sequence in accordance with which the thumbnail images T are sequentially drawn, as shown in FIG. 2B. That is, it is determined that the opaque images at the arrangement orders A and B and the transparent image at the arrangement order C are sequentially drawn in this sequence. The determination of the orders in accordance with which the thumbnail images T are drawn is thus terminated.

It is, however, noted that in another configuration example different from the present embodiment, in which the drawing sequence is determined as described above, the 3D image processor 38 can instead determine, as the sequence in accordance with which the images are sequentially drawn, the orders of the opaque images sequentially arranged downstream from the image to be first drawn.

Specifically, in the other configuration example, the drawing orders of the opaque images at the arrangement order A as the image to be first drawn and the opaque image at the arrangement order B, which is sequentially arranged downstream, that is, in the direction +X from the opaque images at the arrangement order A, can be determined as the sequence in accordance with which the thumbnail images T are sequentially drawn, that is, it can be determined that the opaque images at the arrangement orders A and B can be sequentially drawn in this sequence.

Thereafter, based on the coordinates X of the pages, that is, the thumbnail images T calculated by the image positioner 36 and the drawing orders of the pages, that is, the thumbnail images T determined by the 3D image processor 38, the thumbnail image bundle SG is generated by arranging the thumbnail images T generated by the GUI base section 30 and corresponding to the pages along the first imaginary rotational axis Q in accordance with the determined drawing orders.

Returning to FIG. 5, in step S105, the controller 3 displays the thumbnail image bundle SG formed of the thumbnail images T generated in step S104 on the image display section 2 in accordance with the drawing orders of the thumbnail images T determined in step S104.

That is, the controller 3 sequentially draws the thumbnail images T present in the thumbnail image bundle SG on the image display section 2 in accordance with the drawing orders of the thumbnail images T determined in step S104 including the drawing order determining method according to the present disclosure (drawing step).

In this process, the controller 3 sets the images to be first drawn that have been determined in step S104 including the drawing order determining method according to the present disclosure as candidates of the image to be first drawn. At least one of the candidates is then drawn as the image to be first drawn, and the images after the first drawn image are drawn in accordance with the determined drawing orders. Another image to be first drawn is then further drawn as the image to be first drawn. Thereafter, the images after the first drawn image are drawn in accordance with the determined drawing orders.

Specifically, in the present embodiment, as the arrangement along the first imaginary rotational axis Q corresponding to the thumbnail images T generated by the GUI base section 30, the opaque image at the arrangement order H is first drawn as the image to be first drawn in the first drawing action, and the opaque images at the arrangement orders I and J, which are located on the downstream of the arrangement order H, are drawn in this sequence, as shown in FIG. 2B. In the second drawing action, the opaque image at the arrangement order D is drawn as the image to be first drawn, and the opaque images at the arrangement orders E and F and the transparent image at the arrangement order G, which are located on the downstream of the arrangement order D, are then drawn in this sequence. Further, in the third drawing action, the opaque image at the arrangement order A is drawn as the image to be first drawn, and the opaque image at the arrangement order B and the transparent image at the arrangement order C, which are located on the downstream of the arrangement order A, are then drawn in this sequence. The thumbnail image bundle SG is thus displayed on the image display section 2.

The first to third drawing actions are preferably performed in this sequence. However, the drawing actions may start substantially at the same time, two of the three drawing actions may first start substantially at the same time and the remaining one drawing action may start lastly, or one of the three drawing actions may first start and the remaining two drawing actions may start substantially at the same time or sequentially as long as the drawing orders specified in each of the drawing actions.

In the thumbnail image bundle SG, that is, the image group, part of each of the transparent images overlaps with the downstream opaque image, as shown in FIGS. 2A and 2B.

Consider three-dimensional drawing of the thumbnail image bundle SG including overlapping thumbnail images T, such as those described above. In general, to achieve depth expression, that is, to express the overlapping region, depth information is provided, unlike a situation in which one thumbnail image T is drawn on the image display section, that is, a screen. The depth information dictates that "when a thumbnail image T has been already drawn in a position shallower than the depth of a thumbnail image T to be newly drawn, no new thumbnail image T is drawn," and the drawing process is carried out based on the information.

Use of the drawing process using the depth information to draw images from upstream to downstream on the image display section 2, as described in the aforementioned Related Art section, allows omission of drawing of the overlapping region, that is, acquisition of image data, color calculation, and other processes. The thumbnail image bundle SG can thus be advantageously drawn on the image display section 2 at higher speed.

However, when at least part of a thumbnail image T includes a transparent image having a transparent region in the thumbnail image bundle SG, as shown in FIG. 2B, the depth information causes determination of no need for the drawing of a thumbnail image T located on the downstream of the transparent image in the upstream-to-downstream drawing even when the thumbnail image T has a region that needs to be drawn, resulting in a problem of incorrect drawing of the downstream thumbnail image T corresponding to the transparent portion.

In contrast, in the present disclosure, the thumbnail image bundle SG is displayed on the image display section 2 in accordance with the drawing orders of the thumbnail images T determined in step S104, as described above. Briefly, an opaque image one image downstream a transparent image is determined as the image to be first drawn, and the thumbnail images T are then displayed on the image display section 2 in the orders of opaque images sequentially arranged downstream from the image to be first drawn and the transparent image used last time to determine the image to be first drawn, as shown in FIG. 2B. Therefore, even when the thumbnail images T include a transparent image, a thumbnail image T located downstream the transparent image can be accurately drawn, and the thumbnail image bundle SG can be reliably drawn at high speed.

In the thumbnail image bundle SG shown in FIGS. 2A and 2B, particularly, in the static section L of the thumbnail image bundle SG, the majority of the region of each of the thumbnail images T is hidden by the thumbnail image T on the upstream thereof. The area occupied by the region that does not need to be drawn is therefore large, whereby a large benefit resulting from the high-speed drawing using the depth information can be provided.

Based on the procedure described above, the thumbnail image bundle SG in which the thumbnail images T are arranged in ascending order of page number from right to left along the lateral direction of the image display section 2 is displayed on the image display section 2.

The variety of values calculated in the steps described above are stored in the RAM 5 on a page basis, read from the RAM 5 whenever necessary for calculation, and used in a variety of types of calculation.

According to the viewer 10 as the display apparatus and the display method described above, the thumbnail images T arranged in the static section L are each so displayed as to partially overlap with the adjacent thumbnail image T, whereby part of the contents described in the thumbnail images T is recognizable. Further, the thumbnail images T arranged in the dynamic section V are so displayed that a thumbnail image T closer to the predetermined position K has a smaller angle of rotation θ around the second imaginary rotational axis M, so that a thumbnail image T closer to the predetermined position K has a wider image width, whereby the content described in the thumbnail image T is more readily recognizable. The contents described in all the thumbnail images T are therefore collectively recognizable.

Since the predetermined position K is located at the center of the dynamic section V in the lateral direction in which the plurality of thumbnail images T are juxtaposed, thumbnail images T each having a large image width are arranged on opposite sides of the predetermined position K, whereby the contents described in the thumbnail images T arranged in the dynamic section V are more readily recognizable.

A display method in a case where the user performs predetermined operation by using any of the buttons 7A to 7F or the touch panel 7G of the input section 7 and a display method programmed in advance separately from the aforementioned program that controls the controller 3 will next be described in the form of display examples 1 to 9.

Display Example 1

A display method for enlarging and displaying an image bundle will be described with reference to FIG. 16.

Figure 16:
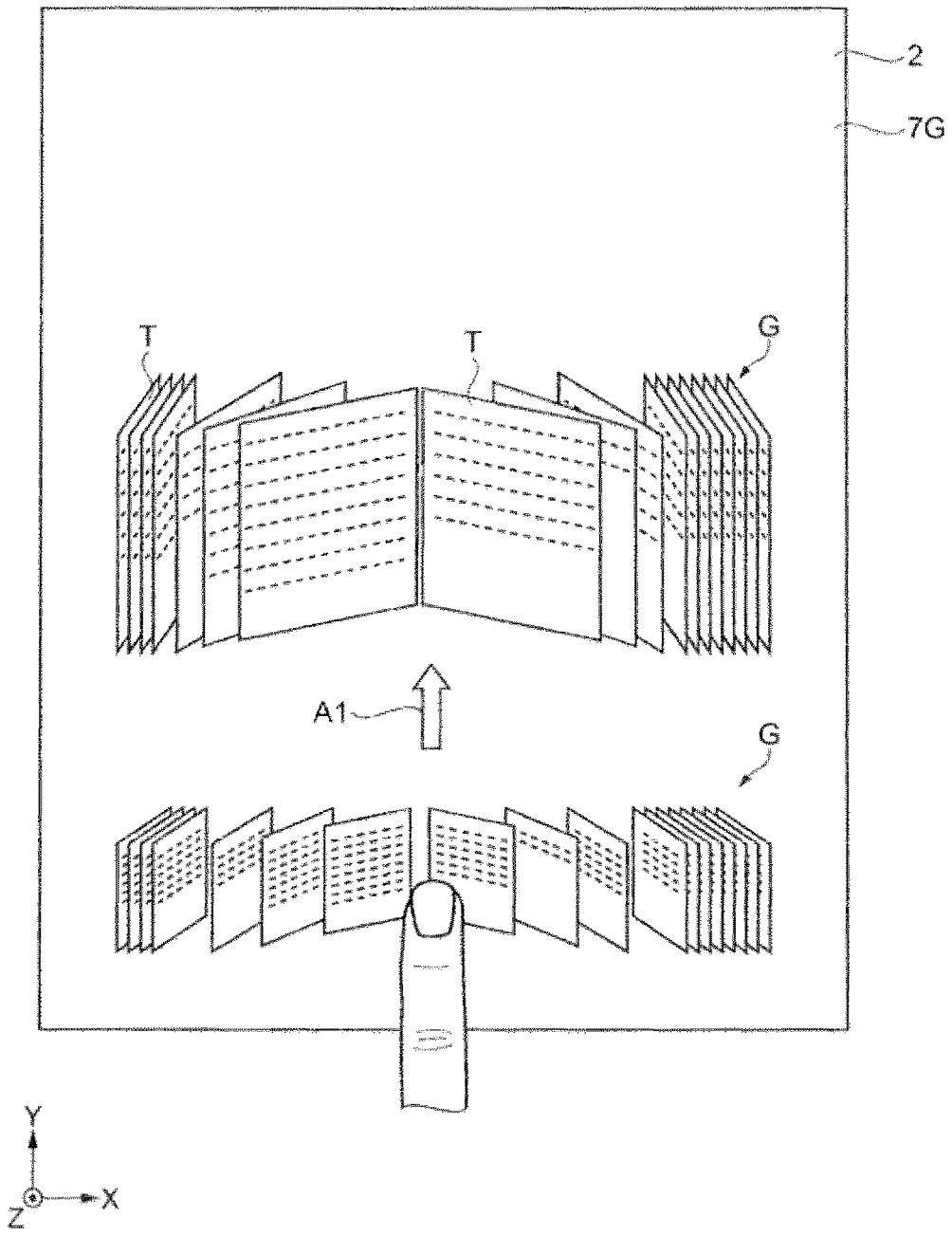
FIG. 16 shows an enlarged, displayed thumbnail image bundle.

FIG. 16 shows an enlarged, displayed thumbnail image bundle. The components of the viewer 10 have the same reference characters described above in the description.

When the user moves the thumbnail image bundle SG with a finger upward, as indicated by the arrow A, and lets the finger separate from the touch panel 7G, the controller 3 enlarges the thumbnail image bundle SG at a predetermined enlargement factor and displays the enlarged thumbnail image bundle SG on the image display section 2 in the vicinity of the region to which the user has moved the thumbnail image bundle SG with the finger, as shown in FIG. 16. When the user moves the enlarged thumbnail image bundle SG downward with a finger and lets the finger separate from the touch panel 7G, the displayed thumbnail image bundle SG returns to the thumbnail image bundle SG having the original size.

The enlarged thumbnail image bundle SG is so displayed that the thumbnail images T are each enlarged at a predetermined enlargement factor with the length of the enlarged thumbnail image bundle SG in the lateral direction, which is the widthwise direction, being equal to the lateral length of the original thumbnail image bundle SG.

The display method described above, which enlarges and displays the thumbnail image bundle SG at a predetermined enlargement factor, readily allows recognition of the contents described in the thumbnail images T in the thumbnail image bundle SG.

Display Example 2

A display method for displaying an image bundle in which the number of images in the dynamic section V is smaller than a predetermined number of images will be described with reference to FIG. 17.

Figure 17:
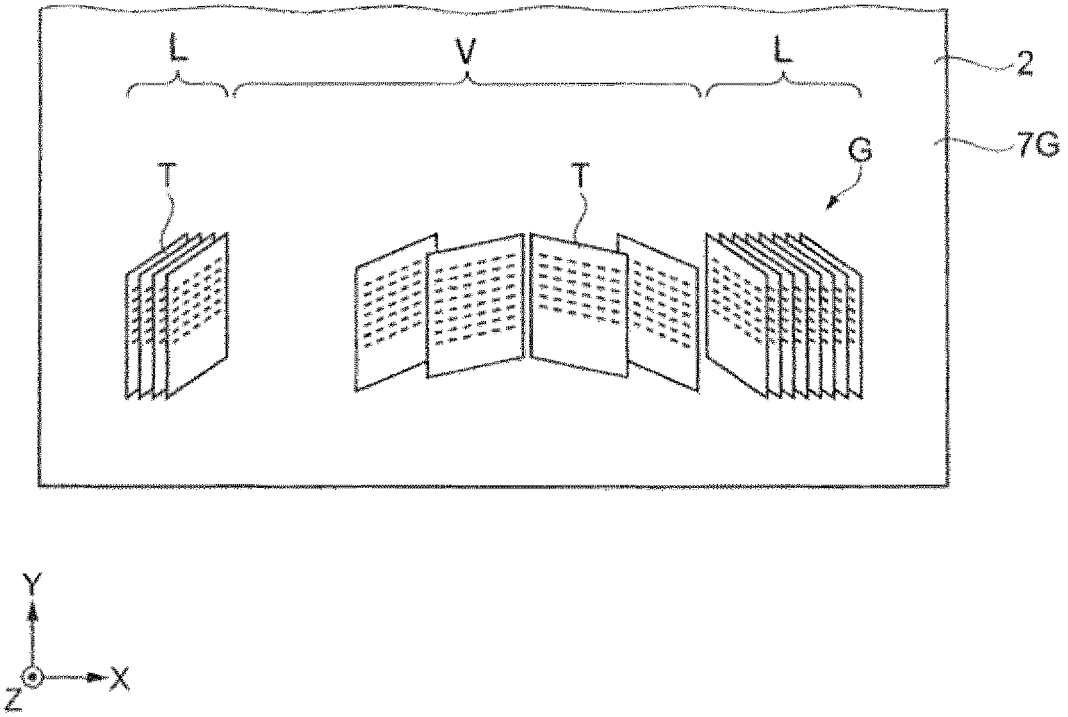
FIG. 17 shows that a thumbnail image bundle in which the number of images in the dynamic section is smaller than a predetermined number of images is displayed.

FIG. 17 shows that a thumbnail image bundle in which the number of images in the dynamic section is smaller than a predetermined number of images is displayed. The components of the viewer 10 have the same reference characters described above in the description.

When the number of images in the dynamic section V is smaller than a predetermined number of images, for example, when the predetermined number of images in the dynamic section V is six and the number of images in the dynamic section V is four, as shown in FIG. 17, the controller 3 calculates an arrangement in which imaginary two images are added to the left of the existent four image, shifts the four thumbnail images T rightward, and displays the images in a right portion of the dynamic section V, as shown in FIG. 17.

According to the display method described above, the small number of images are not sparsely arranged, but continuously arranged images are displayed in a concentrated manner, allowing a beautiful appearance of the displayed images.

Display Example 3

Another display method for displaying an image bundle in which the number of images in the dynamic section V is smaller than a predetermined number of images will be described with reference to FIG. 18.

Figure 18:
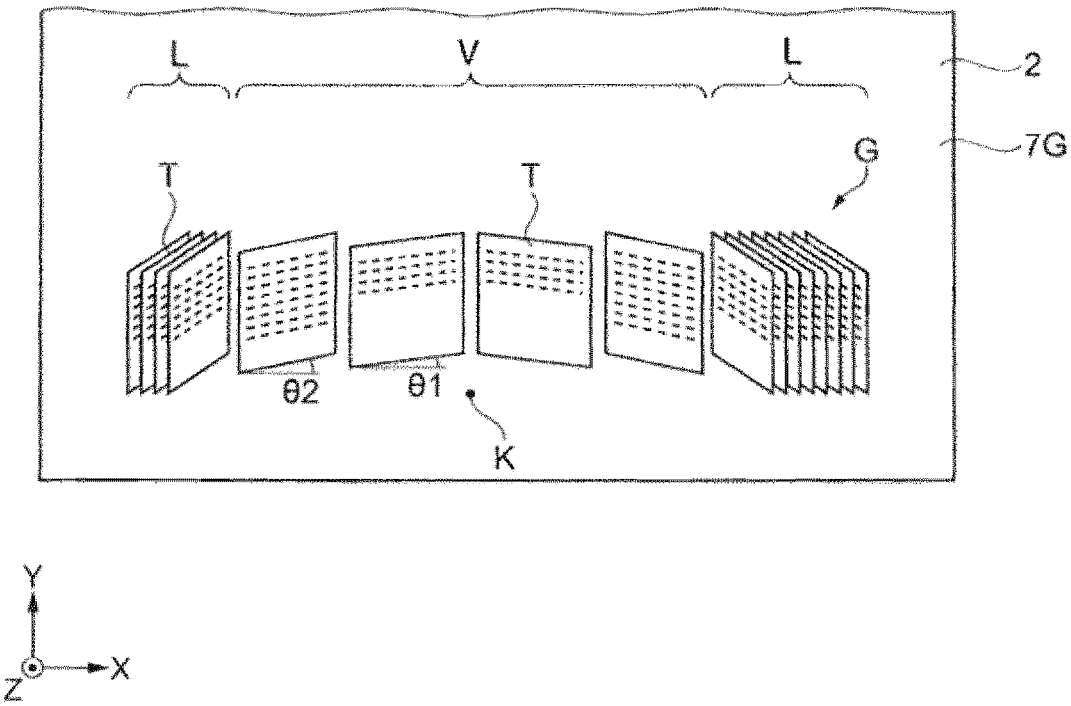
FIG. 18 shows that a thumbnail image bundle in which the number of images in the dynamic section is smaller than a predetermined number of images is displayed.

FIG. 18 shows that a thumbnail image bundle in which the number of images in the dynamic section is smaller than a predetermined number of images is displayed. The components of the viewer 10 have the same reference characters described above in the description.

When the number of images in the dynamic section V is smaller than a predetermined number of images, the user touches any of the thumbnail images T in the dynamic section V with a finger to cause the controller 3 to reduce the angle of rotation θ1 of each of the thumbnail images T arranged in the dynamic section V as compared with the angle of rotation θ when the predetermined number of thumbnail images T are arranged in the dynamic section V and display the resultant thumbnail images T, as shown in FIG. 18. Specifically, when the number of images in the dynamic section V is smaller than the predetermined number of images, the angle of rotation el of the thumbnail image T closest to the predetermined position K is reduced to a value smaller than the angle of rotation el of the thumbnail image T closest to the predetermined position K when the predetermined number of images are arranged in the dynamic section V. Similarly, the angle of rotation θ2 of the thumbnail image T close in the second place to the predetermined position K is reduced to a value smaller than the angle of rotation θ2 of the thumbnail image T close in the second place to the predetermined position K when the predetermined number of images are arranged in the dynamic section V.

When the number of images in the dynamic section V is smaller than a predetermined number of images, a program may automatically control the angle of rotation θ in such a way that the angle of rotation θ of each of the thumbnail images T arranged in the dynamic section V is reduced as compared with the angle of rotation θ when the predetermined number of thumbnail images T are arranged in the dynamic section V.

According to the display method described above, since the thumbnail images T in the dynamic section V are each so displayed that the angle of rotation θ of the thumbnail image T around the second imaginary rotational axis M is reduced, so that the image width of each of the thumbnail images T arranged in the dynamic section V further increases, whereby the contents described in the thumbnail images T arranged in the dynamic section V can be more readily recognized.

Display Example 4

A display method for displaying an image bundle including longitudinally elongated images and laterally elongated images are mixed with each other will be described with reference with FIG. 19.

Figure 19:
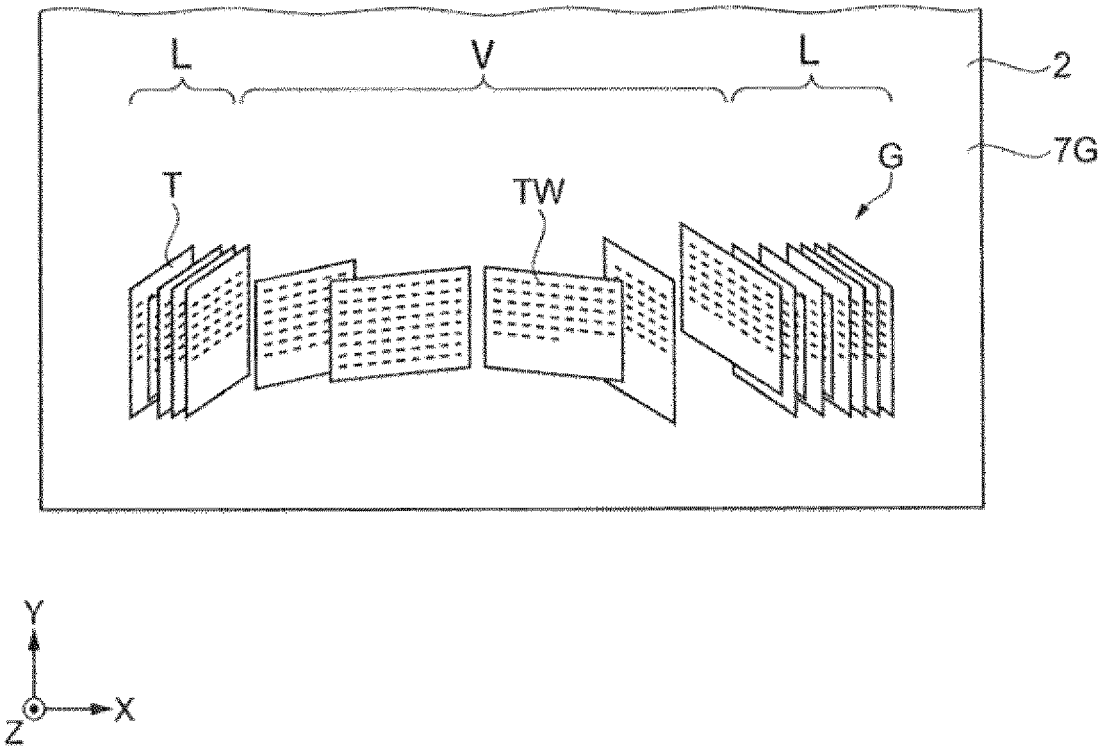
FIG. 19 shows that a thumbnail image bundle including longitudinally elongated images and laterally elongated images mixed with each other is displayed.

FIG. 19 shows that an image bundle including longitudinally elongated images and laterally elongated images are mixed with each other is displayed. The components of the viewer 10 have the same reference characters described above in the description.

In the case of a thumbnail image bundle SG in which longitudinally elongated thumbnail images T each having a lateral length shorter than the longitudinal length and laterally elongated thumbnail images TW each having a lateral length longer than the longitudinal length are mixed with each other in the dynamic section V, as shown in FIG. 19, the controller 3 reduces the number of displayed images in a case where the number of laterally elongated images TW is greater than the number of longitudinally elongated images T in the dynamic section V as compared with the number of displayed images in a case where the number of laterally elongated images TW is smaller than the number of longitudinally elongated images T in the dynamic section V.

According to the display method described above, since the number of images displayed in the dynamic section V is reduced when the number of laterally elongated images TW is greater than the number of longitudinally elongated images T in the dynamic section V, so that the gap between laterally elongated images adjacent to each other increases and the overlapping area decreases accordingly, whereby the contents described in the laterally elongated thumbnail images T are more readily recognizable.

Display Example 5

A display method for displaying an image bundle in which longitudinally elongated images and laterally elongated images are mixed with each other with ends of the images aligned with one another.

Figure 20:
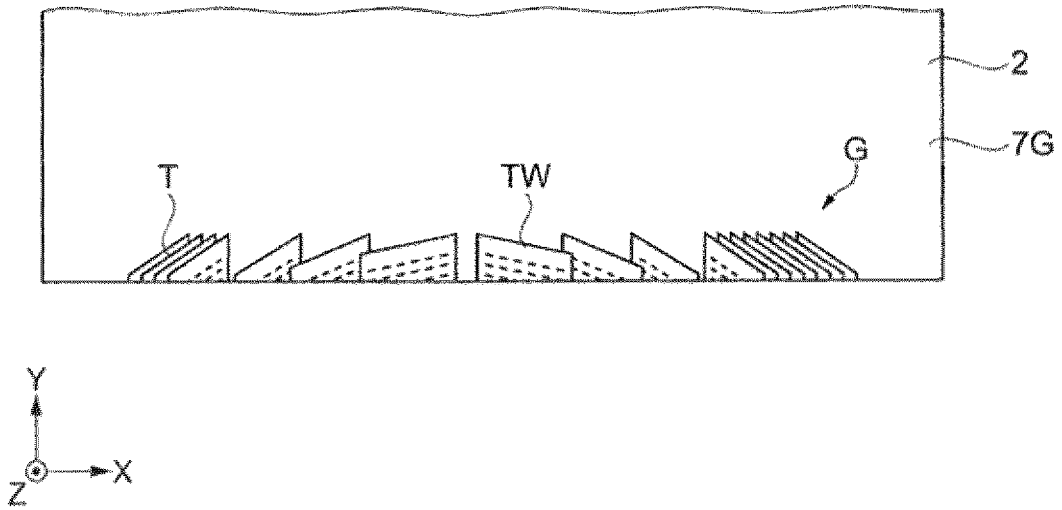
FIG. 20 shows that an image bundle in which longitudinally elongated images and laterally elongated images are mixed with each other is displayed with ends of the thumbnail images aligned with one another.

FIG. 20 shows that an image bundle in which longitudinally elongated images and laterally elongated images are mixed with each other is displayed with ends of the thumbnail images aligned with one another. The components of the viewer 10 have the same reference characters described above in the description.

An image bundle SG in which the longitudinally elongated thumbnail images T and the laterally elongated longitudinally elongated images are mixed with each other is so displayed that the thumbnail images T and TW are shifted toward the center the screen in the longitudinal direction. Therefore, when the user touches the thumbnail image bundle SG with a finger and moves the thumbnail image bundle SG upward or downward to cause part of an upper or lower end portion of the thumbnail image bundle SG not to be displayed on the image display section 2, the controller 3 displays the thumbnail image bundle SG in such a way that one-side ends of the thumbnail images T and TW that are ends facing each other in the longitudinal direction are aligned with one another. Specifically, when only an upper portion of the thumbnail image bundle SG that is a portion that falls within a predetermined range of the thumbnail image bundle SG is displayed, that is, when the lower ends of the thumbnail images T or TW are not displayed, the thumbnail image bundle SG is so displayed that the upper ends of the thumbnail images T and TW are aligned with one another, as shown in FIG. 20. When only a lower portion of the thumbnail image bundle SG that is a portion that falls within a predetermined range of the thumbnail image bundle SG is displayed, that is, when the upper ends of the thumbnail images T or TW are not displayed, the thumbnail image bundle SG is so displayed that the lower ends of the thumbnail images T and TW are aligned with one another.

According to the display method described above, even when the plurality of thumbnail images T and TW that form the thumbnail image bundle SG include the longitudinally elongated images T and the laterally elongated images TW mixed with each other, and one-side ends of the plurality of thumbnail images T and TW that are the ends facing each other in the longitudinal direction are not displayed, the thumbnail image bundle SG, which is formed of the thumbnail images T and TW, is displayed that one-side ends of the thumbnail images T and TW that are ends facing each other in the longitudinal direction are aligned with one another, whereby the contents described in the laterally elongated images TW are recognizable.

Display Example 6

A display method for displaying an operation image and the images adjacent thereto with widened gaps therebetween will be described with reference to FIG. 21.

Figure 21:
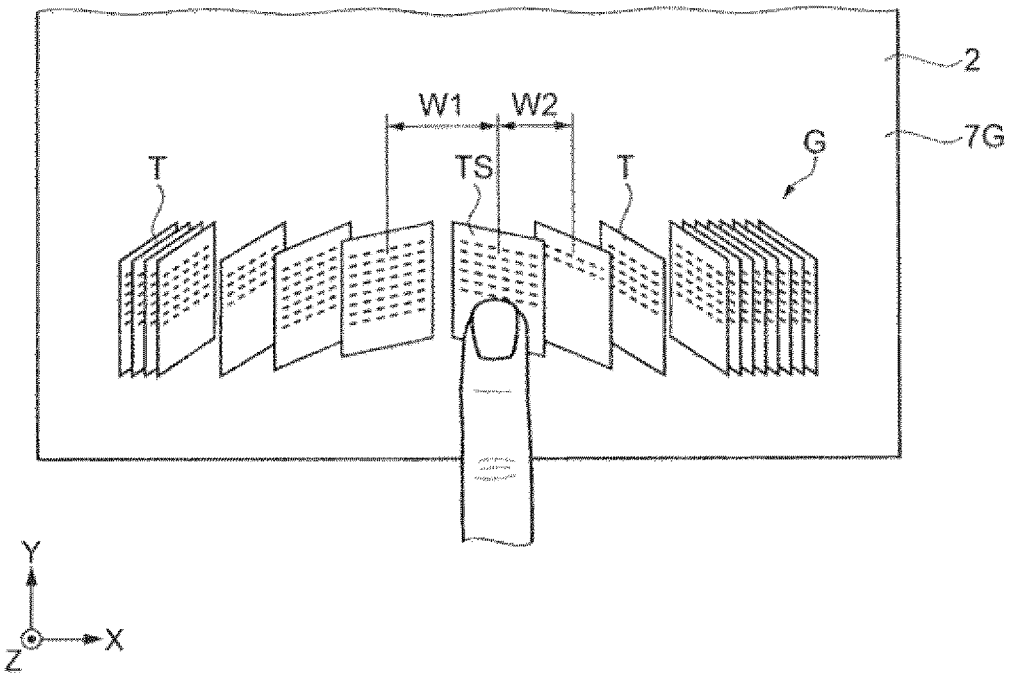
FIG. 21 shows that an operation thumbnail image and thumbnail images adjacent thereto are displayed with widened gaps therebetween.

FIG. 21 shows that an operation thumbnail image and the thumbnail images adjacent thereto are displayed with widened gaps therebetween. The components of the viewer 10 have the same reference characters described above in the description.

When the user performs predetermined operation, for example, touches an operation thumbnail image TS as the operation image with a finger, the controller 3 displays the operation thumbnail image TS and thumbnail images T adjacent thereto with widened gaps therebetween, as shown in FIG. 21. Specifically, the operation thumbnail image TS and the thumbnail images T are so displayed that a gap W1 between the operation thumbnail image TS and the thumbnail image T on the left thereof and a gap W2 between the operation thumbnail image TS and the thumbnail image T on the right thereof are widened as compared with the gaps before the predetermined operation of touching the operation thumbnail image TS with the finger.

According to the display method, since the operation thumbnail image TS and the thumbnail images T adjacent thereto are displayed with widened gaps therebetween, so that the size of the region where the operation thumbnail image TS overlap with each of the thumbnail images T adjacent thereto decreases, whereby the contents described in the operation thumbnail image TS and the thumbnail images T adjacent thereto are readily recognizable.

Display Example 7

A display method for displaying the operation image and the images adjacent thereto in such a way that the operation image and the images adjacent thereto do not overlap with each other will be described with reference to FIG. 22.

Figure 22:
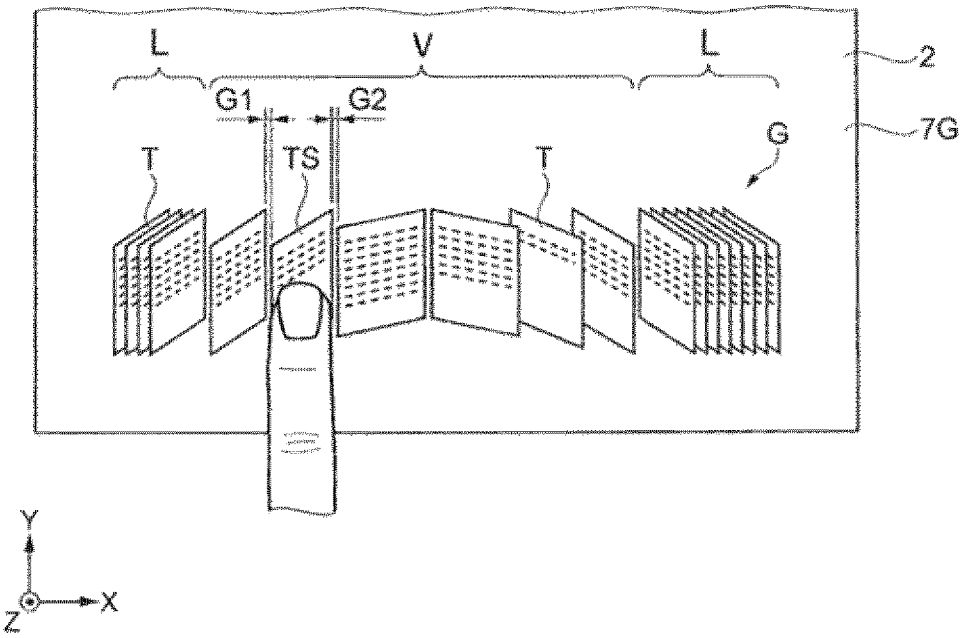
FIG. 22 shows that the operation thumbnail image and thumbnail images adjacent thereto are so displayed as not to overlap with each other.

FIG. 22 shows that the operation thumbnail image and the thumbnail images adjacent thereto are so displayed as not to overlap with each other. The components of the viewer 10 have the same reference characters described above in the description.

When the user performs predetermined operation, for example, touches the operation thumbnail image TS as the operation image placed in the dynamic section V for at least a predetermine period, for example, at least one second, the controller 3 displays the operation thumbnail image TS and the thumbnail images T adjacent thereto in such a way that the operation thumbnail image TS and the thumbnail images T adjacent thereto do not overlap with each other, as shown in FIG. 22. Specifically, the operation thumbnail image TS and the thumbnail images T adjacent thereto are so displayed that a gap G1 is provided between the operation thumbnail image TS and the thumbnail image T on the left thereof and a gap G2 is provided between the operation thumbnail image TS and the thumbnail image T on the right thereof.

According to the display method described above, since the operation thumbnail image TS and the thumbnail images T adjacent thereto arranged in the dynamic section V are so displayed as not to overlap with each other, the contents described in the operation thumbnail image TS and the thumbnail images T adjacent thereto are readily recognizable.

Display Example 8

A display method for displaying the images in the dynamic section V in such a way that the images are moved into the static section L will be described with reference to FIGS. 23 and 24.

Figure 23:
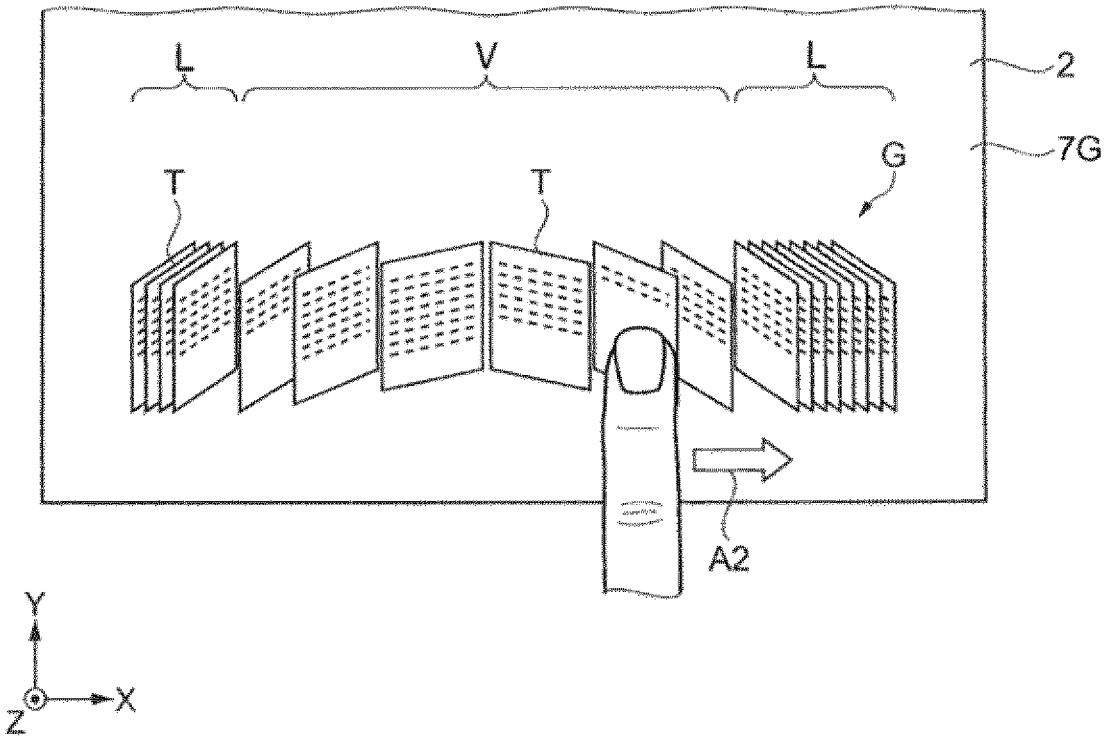
FIG. 23 describes a method for displaying the thumbnail images in the dynamic section in such a way that the thumbnail images are moved into the static section.

FIG. 23 describes the method for displaying the thumbnail images in the dynamic section in such a way that the thumbnail images are moved into the static section. The components of the viewer 10 have the same reference characters described above in the description.

Figure 24:
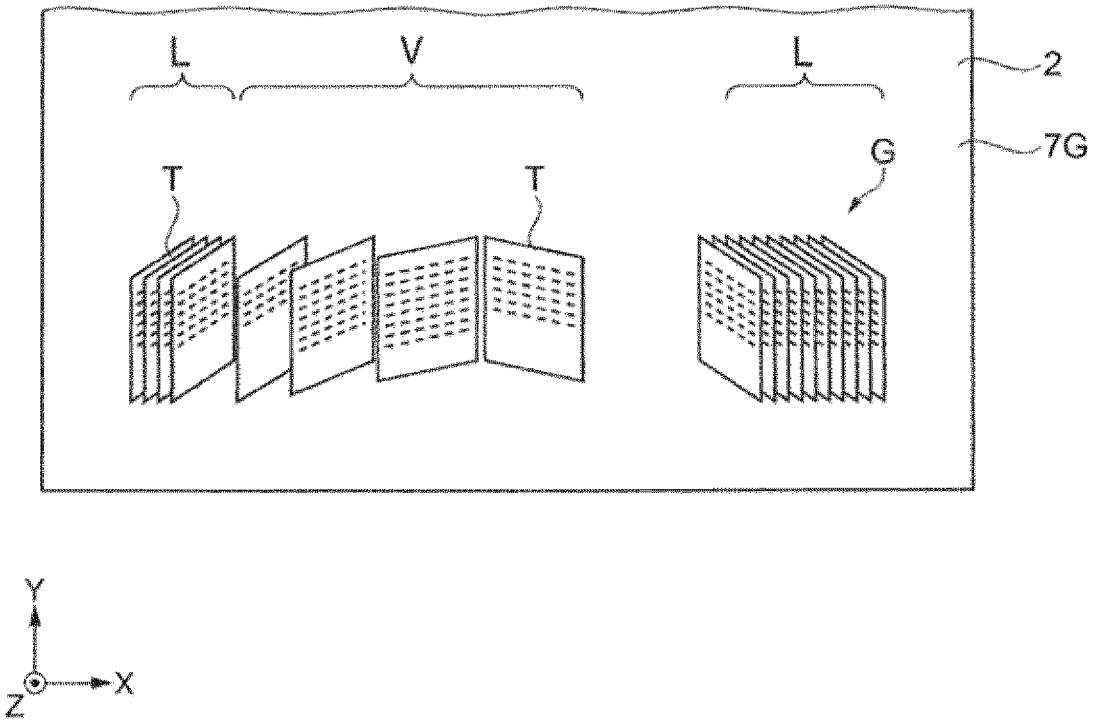
FIG. 24 shows that the thumbnail images in the dynamic section are displayed in such a way that the thumbnail images are moved into the static section.

When the user touches any of the thumbnail images T arranged in the dynamic section V with a finger to move the thumbnail image T rightward, as indicated by the arrow A2, the controller 3 moves the thumbnail image T touched with the finger and the thumbnail images T between the thumbnail image T touched with the finger and the static section L into the static section L, as shown in FIG. 23, and the controller 3 arranges the moved thumbnail images T in the static section L and displays the arranged thumbnail images T, as shown in FIG. 24. That is, the thumbnail images T displayed in the dynamic section V are movable into the static section L. The thumbnail images T displayed in the static section L are also movable into the dynamic section V. Specifically, any of the thumbnail images T in the static section L can be so touched as to be moved into the dynamic section V and displayed.

According to the display method, the number of thumbnail images T arranged in the dynamic section V can be reduced, whereby the thumbnail images T arranged in the dynamic section V are more readily visible.

Display Example 9

A display method for displaying a thumbnail image bundle with the width thereof reduced will be described with reference to FIGS. 25 and 26.

Figure 25:
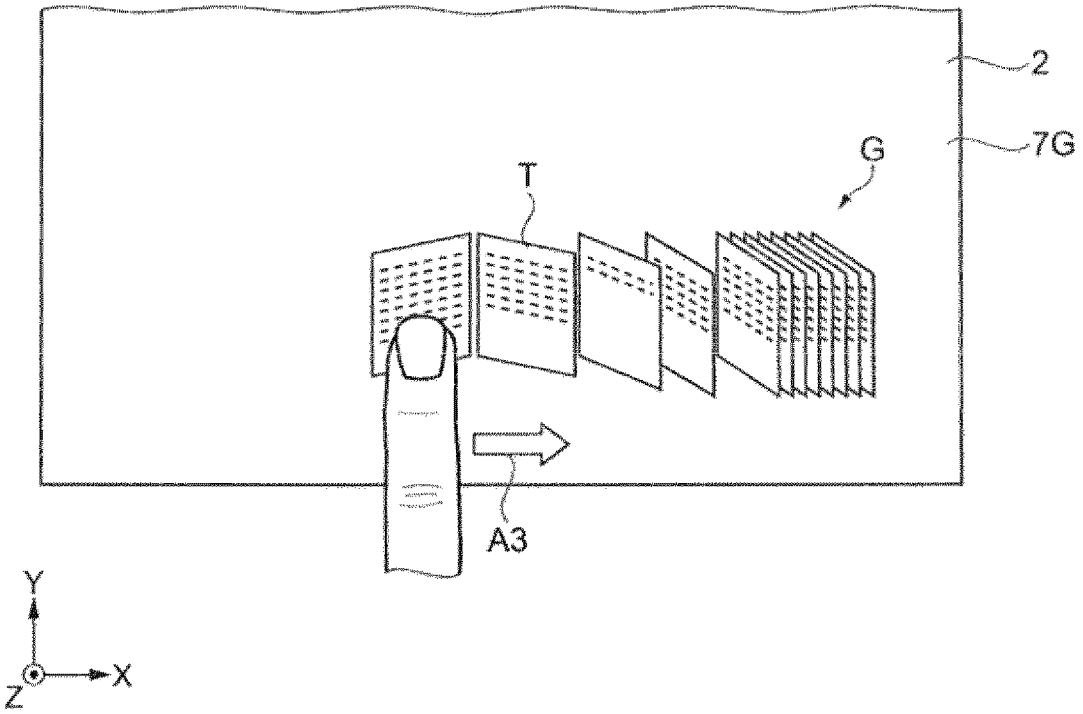
FIG. 25 describes a method for displaying a thumbnail image bundle with the width thereof reduced.
Figure 26:
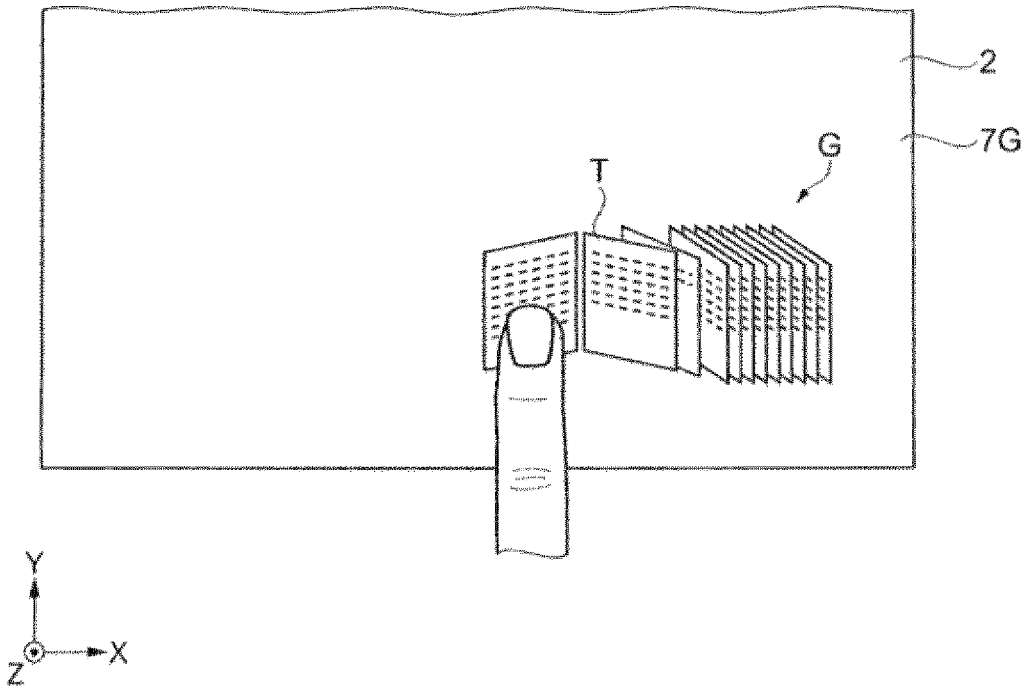
FIG. 26 describes the method for displaying a thumbnail image bundle with the width thereof reduced.

FIGS. 25 and 26 describe the method for displaying a thumbnail image bundle with the width thereof reduced. The components of the viewer 10 have the same reference characters described above in the description.

When the user touches the thumbnail image T placed in the leftmost position in the thumbnail image bundle SG with a finger to move the thumbnail image T rightward, as indicated by the arrow A3, as shown in FIG. 25, the controller 3 displays the thumbnail images T with the length of the thumbnail image bundle SG in the lateral direction, which is the width direction thereof, reduced, as shown in FIG. 26. When the user lets the finger separate from the touch panel 7G, the thumbnail image bundle SG having the original width is displayed. The thumbnail image bundle SG can be so displayed as to be shifted leftward with the lateral length of the thumbnail image bundle SG reduced.

According to the display method described above, when the thumbnail image bundle SG is so displayed as to overlap, for example, with enlarged thumbnail images T or another thumbnail image bundle SG, the thumbnail image bundle SG can be displayed with the width thereof reduced, whereby the contents described in the enlarged thumbnail images T or the other thumbnail image bundle SG with which the thumbnail image bundle SG overlapped are readily recognizable.

Contents derived from the embodiment described above will be described below.

The display method derived from the embodiment described above is a display method including rotating a plurality of images arranged along a first imaginary axis around a second imaginary axis that intersects the first imaginary axis, further rotating the plurality of images around the first imaginary axis, and displaying the resultant plurality of images on a display section. An image bundle formed of the plurality of images arranged along a first direction has the static section L, in which the images therein are juxtaposed at equal intervals with adjacent images partially overlapping each other, and the dynamic section V, in which the images therein are so arranged with the gap between adjacent images being greater than the gap between adjacent images in the static section L. The images displayed in the dynamic section V are movable into the static section L. The images in the dynamic section V are so arranged that an image closer to a predetermined position has a smaller angle of rotation around the second imaginary axis along a second direction that intersects the first direction.

According to the display method, the images arranged in the static section L are each so displayed as to partially overlap with the adjacent image, whereby part of the contents described in the images is recognizable. Further, the images arranged in the dynamic section V are so displayed that an image closer to the predetermined position has a smaller angle of rotation around the second imaginary axis, so that an image closer to the predetermined position has a wider image width, whereby the content described in the image is more readily recognizable. The contents described in all images are therefore collectively recognizable.

In the display method described above, the predetermined position may be the center of the dynamic section V in the first direction.

According to the display method described above, since the predetermined position is located at the center of the dynamic section V in the first direction, in which the plurality of images are juxtaposed, images each having a large image width are arranged on opposite sides of the predetermined position, whereby the contents described in the images arranged in the dynamic section V are more readily recognizable.

In the display method described above, the image bundle may be enlarged at a predetermined enlargement factor when the image bundle is moved in the second direction, and the enlarged image bundle may be displayed.

According to the display method described above, which enlarges and displays the image bundle at a predetermined enlargement factor, readily allows recognition of the contents described in the images in the image bundle.

In the display method described above, when the number of plurality of images in the dynamic section V is smaller than a predetermined number of images, the angle of rotation of each of the plurality of images displayed in the dynamic section V may be reduced as compared with the angle of rotation in a case where the predetermined number of images are arranged in the dynamic section V.

According to the display method described above, since the images in the dynamic section V are each so displayed that the angle of rotation of the image around the second imaginary axis is reduced, so that the image width of each of the images arranged in the dynamic section V further increases, whereby the contents described in the images arranged in the dynamic section V are more readily recognizable.

In the display method described above, in a case where the number of images each having a length in the first direction longer than the length in the second direction is greater than the number of images each having a length in the first direction shorter than the length in the second direction in the dynamic section V, the number of displayed images in the dynamic section V may be reduced as compared with the number of displayed images in a case where the number of images each having a length in the first direction shorter than the length in the second direction is greater than the number of images each having a length in the first direction longer than the length in the second direction.

According to the display method described above, the number of images in the dynamic section V is reduced when the number of laterally elongated images each having a length in the first direction longer than the length in the second direction is greater than the number of longitudinally elongated images each having a length in the first direction shorter than the length in the second direction, so that the gap between laterally elongated images adjacent to each other increases and the overlapping area decreases accordingly, whereby the contents described in the laterally elongated thumbnail images T arranged in the dynamic section V are more readily recognizable.

In the display method described above, when part of the image bundle is not displayed, the thumbnail image bundle may be so displayed that one-side ends of the plurality of images forming the image bundle that are ends facing each other in the second direction are aligned with one another.

According to the display method described above, when part of the image bundle is not displayed, the image bundle may be so displayed that one-side ends of the plurality of images forming the image bundle that are ends facing each other in the second direction are aligned with one another, whereby the contents described in the laterally elongated images are recognizable.

In the display method described above, an operation image on which predetermined operation has been performed in the image bundle may be so displayed that the gaps between the operation image and the images adjacent thereto are widened.

According to the display method described above, since the operation image and the images adjacent thereto are displayed with widened gaps therebetween, so that the size of the region where the operation image overlap with each of the images adjacent thereto decreases, whereby the contents described in the operation image and the images adjacent thereto are readily recognizable.

In the display method described above, when the operation image on which predetermined operation has been performed in the image bundle is placed in the dynamic section V, the operation image and the images adjacent thereto may be so displayed as not to overlap with each other.

According to the display method described above, since the operation image and the images adjacent thereto arranged in the dynamic section V are so displayed as not to overlap with each other, the contents described in the operation image and the images adjacent thereto are readily recognizable.

A display apparatus derived from the embodiment described above includes a display section that displays an image bundle formed of a plurality of images arranged along a first direction, an image generator that rotates the plurality of images arranged along a first imaginary axis along the first direction around a second imaginary axis that intersects the first imaginary axis and further rotates the plurality of images around the first imaginary axis to create the plurality of images, and a controller that displays the image bundle having the static section L, in which the images therein are juxtaposed at equal intervals with adjacent images partially overlapping each other, and the dynamic section V, in which the images therein are so arranged with the gap between adjacent images being greater than the gap between adjacent images in the static section L, and displays the images in the dynamic section V in such a way that an image closer to a predetermined position has a smaller angle of rotation around the second imaginary axis along a second direction that intersects the first direction.

According to the display apparatus described above, the images arranged in the static section L are each so displayed as to partially overlap with the adjacent image, whereby part of the contents described in the images is recognizable.

Further, the images arranged in the dynamic section V are so displayed that an image closer to the predetermined position has a smaller angle of rotation around the second imaginary axis, so that an image closer to the predetermined position has a wider image width, whereby the content described in the image is more readily recognizable. The contents described in all images are therefore collectively recognizable.

The drawing apparatus according to the present disclosure is not limited to the viewer shown in FIG. 1 and can, for example, be a personal computer, a mobile phone, a digital still camera, a television receiver, a video camcorder, a video tape recorder, a car navigator, an electronic dictionary, a desktop calculator, an electronic game console, a word processor, a workstation, a TV phone, a security television monitor, electronic binoculars, a POS terminal, an electronic instrument including a touch panel, a medical instrument, a fish finder, a variety of measuring instruments, a variety of meters, a flight simulator, a variety of other monitors, and an apparatus including an image display section, such as a projector and other projection-type display apparatuses.

The drawing order determining method, the drawing method, and the drawing apparatus according to the present disclosure have been described above based on the illustrated embodiment, but the present disclosure is not limited thereto.

For example, in the drawing order determining method and the drawing method according to the present disclosure, one or more steps for arbitrary purposes may be added as required.

In the drawing apparatus according to the present disclosure, each configuration can be replaced with an arbitrary configuration that can provide the same function, or an arbitrarily configuration can be added.

What is claimed is:

1. A drawing order determining method for handling an image group which includes at least one transparent image having a transparent portion and a plurality of opaque images each having no transparent portion and in which arrangement orders of the images are determined in advance, the method comprising:

identifying positions where the transparent image and the opaque images are placed, wherein the transparent image and the opaque images are juxtaposed in a lateral direction such that adjacent images overlap;

determining images to be drawn first in the image group by a first step of determining an opaque image of the opaque images one image downstream of the transparent image as one of the images to be drawn first, and a second step of determining another opaque image of the opaque images at a most upstream position as another of the images to be drawn first.

2. The drawing order determining method according to claim 1, wherein the transparent image has a flag showing that the transparent image has the transparent portion.

3. The drawing order determining method according to claim 1, wherein part of the transparent image overlaps with the opaque image.

4. The drawing order determining method according to claim 1, wherein when the image group includes n transparent images, wherein (n is an integer greater than or equal to two), the first step is repeated n times, and then the second step is carried out.

5. The drawing order determining method according to claim 4, wherein in the first step carried out for the first time, orders of the opaque images that are sequentially arranged downstream from the one of the images to be drawn first are determined as a sequence in accordance with which the images are sequentially drawn.

6. The drawing order determining method according to claim 4, wherein in the first step to be carried out for n-th time, orders of the opaque images sequentially arranged downstream from the image to be drawn first and the transparent image used in the first step carried out for (n−1)-th time are determined as the sequence in accordance with which the images are sequentially drawn.

7. The drawing order determining method according to claim 4, wherein in the second step, orders of the opaque images sequentially arranged downstream from the image to be drawn first and the transparent image used in the first step carried out for n-th time are determined as the sequence in accordance with which the images are sequentially drawn.

8. The drawing order determining method according to claim 1, further comprising sequentially drawing the images present in the image group in accordance with drawing orders determined.

9. A drawing apparatus comprising:

a display; and one or more processors configured to acquire an image group which includes at least one transparent image having a transparent portion and a plurality of opaque images each having no transparent portion and in which arrangement orders of the images are determined in advance, identify positions where the transparent image and the opaque images are placed in the image group, wherein the transparent image and the opaque images are juxtaposed in a lateral direction such that adjacent images overlap, determine an opaque image of the opaque images that is one image downstream of the transparent image as one of the images to be drawn first in the image group, determine an opaque image of the opaque images that is at a most upstream position as another of the images to be drawn first, and draw the images to be drawn first on the display.

* * * * *